US005737780A

United States Patent [19]

Okita et al.

[11] Patent Number: 5,737,780

[45] Date of Patent: Apr. 14, 1998

[54] SEAT LIFTING DEVICE FOR A STOOL

[75] Inventors: Koru Okita; Shigeo Saeki, both of Hyogo-Ken; Koichi Yamada, Osaka; Jiro Koshijima, Osaka; Kenichi Kobayashi, Osaka, all of Japan

[73] Assignees: Nippon Cable System Inc., Hyogo-ken; Matsushita Electric Works, Ltd., Osaka-fu, both of Japan

[21] Appl. No.: 634,864

[22] Filed: Apr. 19, 1996

[30] Foreign Application Priority Data

| | | | |
|---|---|---|---|
| Apr. 19, 1995 | [JP] | Japan | 7-119286 |
| Sep. 30, 1995 | [JP] | Japan | 7-276912 |
| Sep. 30, 1995 | [JP] | Japan | 7-276913 |
| Sep. 30, 1995 | [JP] | Japan | 7-276914 |

[51] Int. Cl.[6] ..... A47K 13/10

[52] U.S. Cl. ..... 4/667; 4/254

[58] Field of Search ..... 4/254, 667; 297/DIG. 10

[56] References Cited

U.S. PATENT DOCUMENTS

| | | | |
|---|---|---|---|
| 4,168,552 | 9/1979 | Austin | 4/667 |
| 4,185,335 | 1/1980 | Alvis | 4/667 |
| 4,993,085 | 2/1991 | Gibbons | 4/667 |
| 5,027,446 | 7/1991 | Robertson | 4/254 |
| 5,142,709 | 9/1992 | McGuire | 4/667 |
| 5,312,157 | 5/1994 | Logan, Jr. | 4/667 X |
| 5,561,872 | 10/1996 | Phillips | 4/667 |

FOREIGN PATENT DOCUMENTS

| | | |
|---|---|---|
| 49-33508 | 9/1974 | Japan . |
| 62-275422 | 11/1987 | Japan . |
| 3-24213 | 4/1991 | Japan . |
| 5-305038 | 11/1993 | Japan . |

*Primary Examiner*—Robert M. Fetsuga
*Attorney, Agent, or Firm*—Lowe, Price, LeBlanc & Becker

[57] ABSTRACT

A seat-lifting device having a pair of left and right units 3, 4 arranged on both sides of a stool 1 in a toilet. The units 3, 4 are connected mutually by a connecting frame 5. Each unit 3, 4 has a guide portion 7 and a cable-driving portion 10 which are connected with a pair of conduits for guiding a cable. The guide portion 7 has a static guide 11, 14, a sliding plate 13 slidably supported with the static guide, a seat-supporting member 15 tiltably mounted on the sliding member, and a gas spring 17 urging the rear portion of the seat-supporting member. The sliding plate 13 is driven by the cable-driving portion through a loop of cable.

20 Claims, 23 Drawing Sheets

SEAT LIFTING DEVICE FOR A STOOL

TECHNICAL FIELD OF THE INVENTION

The present invention relates to a seat-lifting device for a stool, and particularly to a device for effecting powered vertical motion of a seat of a toilet stool in order to assist a physically handicapped person or old aged person, when he or she sits down and rises up from the stool.

RELATED ARTS

Japanese Examined Utility Model Publication No. 33508/1974 (Prior art 1) discloses a Japanese-style toilet stool having a cylindrical outer frame with oval cross-section and an inner frame inserted in the outer case so that the inner case can slide vertically. The stool has also a rotatable vertical screw rod, and a nut member fixed to a front end of the inner case is engaged with the screw rod. The inner case can be actuated vertically by turning the screw rod in a direction and another direction.

Japanese Unexamined Patent Publication No. 275422/1987 (Prior art 2) discloses a seat-lifting device for a western style toilet stool. The device has a guide pillar with square cross-section. A square tubular member is slidably mounted on the guide pillar. The tubular member supports a seat at the rear end of the seat. A hydraulic cylinder is housed in the guide pillar and actuates the tubular member vertically.

Farther, Japanese examined Patent Publication No. 24213/1991 (Prior art 3) discloses another seat-lifting device having a pair of guide rails at a rear end of a stool and a moving plate mounted on the guide rails for sliding motion. A sprocket wheel or chain wheel is rotatably mounted at the upper end of each guide rail and is wrapped with a roller chain. The moving plate is supported with a pair of chains, and the moving plate is actuated vertically by virtue of motion of the roller chains. In the seat-lifting device, the pair of guide rails are gradually bent to the front side at the upper portion. The seat therefore tilts to front side when the seat comes to the upper portion, so that a user can easily sit on the seat and can easily rise from the seat.

Japanese Unexamined Patent Publication No. 305038/1993 (Prior art 4) discloses a seat-lifting device having a pair of pipe-like posts, a moving frame slidably supported on the posts at a rear end of a stool. The device has a rack-and-pinion mechanism. A rack is inserted in the post, and a pinion is rotatably mounted on the moving frame. The pinion is driven to rotate in the both directions by an electric motor mounted on the moving frame. In addition, the device has a seat having a rear end pivotally jointed to the moving frame such that the seat can rotate between a horizontal posture and a posture tilting to the front side. And a stopper is attached on the stool so as to support the front side of the seat to keep horizontal posture when the seat comes on the stool and to keep the tilted posture when the seat rises from the stool.

In the above-mentioned known seat-lifting devices, an actuating mechanism and a guide mechanism are attached at the front or rear portion of a stool, and those mechanisms project upward from the upper face of the seat. Therefore, the stools cannot be comfortably used for a normal person, and the devices are not desirable for domestic use stools which are commonly used by normal persons and physically handicapped persons. Further, in the above-mentioned devices, the seat or main body (inner case) is supported at the rear end or the front end thereof so as to form a cantilever-type support. Therefore, the guide mechanism is complicated, and the device has large size and occupies large space in a toilet.

The hydraulically powered device of the prior art 2 requires especially large space, since a hydraulic power generating unit is necessary. In the device of the prior art 3 and the prior art 4, though an electric motor is used for power sourse, the actuating mechanisms are relatively large, and they are not desirable to set in a domestic toilet.

In the seat-lifting device of the prior art 3, the guide surface of the guide rail is curved at the upper portion in the front side, and guide function therefore is not stable. Further, since moving frame is tilted with the elevating motion, a flexible power transmitting element such as a chain is required. Then, construction of the guide portion is complicated and large-scaled. Further, starting position of tilt motion and tilt angle cannot be easily regulated, since starting position and tilt angle are determined on the basis of the form of the guide rail inevitably.

In the device of the prior part 4, angle of the seat changes rapidly at the bottom of the travel of the seat. Therefore, the user is not comfortable.

SUMMARY OF THE INVENTION

An object of the present invention is to provide a seat-lifting device which do not require any upper projecting mechanism such as actuating device and guide mechanism, and which can be easily and comfortably used by not only a physically handicapped person, but also a normal person.

Another object of the present invention is to provide a small seat-lifting device so as not to occupy large space in a toilet, especially in a domestic toilet.

Another object of the present invention is to provide a seat-lifting device in which a seat can be slowly tilted to the front side and be returned during the lifting motion, and the starting point of the tilt motion and the tilt angle can be easily regulated.

According to the first aspect of the present invention, there is provided a seat-lifting device which has a pair of left and right static guides to be set on left and right sides of a stool, respectively, left and right moving members mounted on the left and right static guides, respectively, for up-and-down sliding motion and each moving member having a seat supporting portion at an upper end thereof, and an actuating mechanism for actuating the moving members in up-and-down direction, which is attached at a position adjacent to one of the static guides.

In a preferable case, the above-mentioned seat-lifting device has a connecting frame bridging rear portions of the left and right static guides. The connecting frame can has a portion to be fixed on an upper rear end of the stool. The above-mentioned actuating mechanism preferably has direction-changing members attached to upper and lower ends of the static guide, a pull cable arranged between the direction-changing members and having a portion connected to a lower portion of the moving member, and a motor-powered cable actuator for alternately pulling ends of the pull cable.

In a preferable case, a means for urging the moving member upward is interposed between the moving member and the static guide. In a preferable case, both seat-supporting portions of the left and right moving members are a pair of members which are rotatably mounted on upper portions of the left and right moving members so as to rotate around a common rotational axis in a range between a horizontal posture and a posture tilted in front side. In a more preferable case, each seat-supporting member is elastically urged to tilt in the front side by means of an urging means. Such urging means is preferably a compression spring interposed between a rear portion of the seat-supporting member and the static guide so that the seat-supporting member is urged upward. The word "compression spring" includes what is called gas spring, and the gas spring is preferably employed as the compression spring.

In the above-mentioned seat-lifting device with a connecting frame, it is preferable that the connecting frame is made of a pipe through which electric codes are inserted in order to electrically connect left and right actuating units mutually. The connecting frame has preferably an inverse-U shape i.e. a pair of vertical portions and a lateral portion connecting upper ends of the vertical portions mutually. Further, the cords in the connecting frame are preferably separated by means of two sets of connectors at positions where the connecting frame and the actuator units are jointed. Further, in a preferable case, there are provided left and right control cords and an operation switch which can be slectively connected with either left and right control cords. In a preferable case, left or right arms are attached to the vertical portions of the connecting frame, and control cords are inserted through the both arms, such that the operation switch can be selectively attached at either front ends of the arms.

In further preferable case, each actuator unit has a control circuit and a power circuit therein, one of the actuator units has a receiving circuit for receiving electric power from outer power source and a main switch, and another unit is supplied with electric power through the receiving circuit, the main switch and the power cords in the connecting frame. In this case, a switching regulator is preferably employed as the power circuit in the seat-lifting device.

As a preferable seat-lifting device, each actuating unit has a static cover, a movable cover and a sliding inner cover. The static cover has a tubular portion enclosing the static guide therein, and the tubular portion has an opening at an upper end thereof. The movable cover has a box-like shape with a top plate and side walls. The top plate is interposed between the seat-supporting member and a seat to be mounted thereon. The side walls extend downward from the front periphery and side peripheries of the top plate with remaining the rear side open, so that the upper portion of the static cover is covered with the movable cover. The inner sliding cover is situated at rear side of the movable cover and at inside of the static cover so that the sliding cover can close the rear opening of the movable cover. Further, the inner sliding cover is supported so as to move in up-and-down direction synchronous with the sliding member. The covering construction can also be suitably employed in a seat-lifting device with a mechanism for tilting a seat-supporting member in a range between the horizontal posture and a front-tilted posture. In a seat-lifting device with gas spring for urging the seat-supporting member upward, the sliding cover can be attached to a cylinder of the gas spring.

According to the second aspect of the present invention, there is provided a seat-lifting device which has a static guide, a moving member, cable guides for changing direction of a cable provided on an upper portion and lower portion of the static guide, a cable or wire having a portion fixed to the moving member and being engaged with the cable guides, a motor-powered cable driving portion for alternately pulling the ends of the cable, and conduits for slidably guiding the cable. In the second aspect of the device, a means for urging the seat upward is preferably employed. Further, a compression spring interposed between the seat and the static guide can be preferably employed as the urging means. A compression spring with a pneumatic damper or a gas spring can be more preferably as the compression spring.

According to the third aspect of the present invention, there is provided a seat-lifting device which has a static guide, a sliding member slidably mounted on the static guide for up-and-down motion, a tilting member having a seat-supporting portion at an upper end thereof and being rotatably attached to an upper portion of the sliding member, an urging means for urging the tilting member in front side, an actuating mechanism for actuating the sliding member up and down, and a cam mechanism for tilting the tilting member to the front side and horizontal side as the sliding member goes up and down.

The cam mechanism can be a combination of a cam member and a cam roller. The cam member has a cam surface extending up-and-down direction. Either cam member or cam roller is attached to the tilting member, and another is attached to the static guide. That is to say, when the cam member is provided to the static guide, the cam roller is rotatably attached to the tilting member, vice versa. In a preferable case, the cam surface and/or the cam roller is adjustable in the front-rear direction. The wording "provided to a static guide" includes not only a case where the cam member or the cam roller is directly attached to the static guide but also a case where the cam element is indirectly attached to the static guide by means of a bracket or the like, the cam element is formed in the static guide integrally, the cam element is attached to a base plate or the like which supports the static guide, and the like.

In this aspect of the invention, the urging means is preferably a compression spring which urges upward the tilting member at a rear portion with respect to a rotation axis. For example, a gas spring of which ends are connected to the tilting member and the static guide can be suitably employed.

Hereinafter, the above-mentioned seat-lifting device for a stool of the present invention will be explained in detail referring to the accompanying drawings.

DETAILED DESCRIPTION OF THE INVENTION

Figure 1:
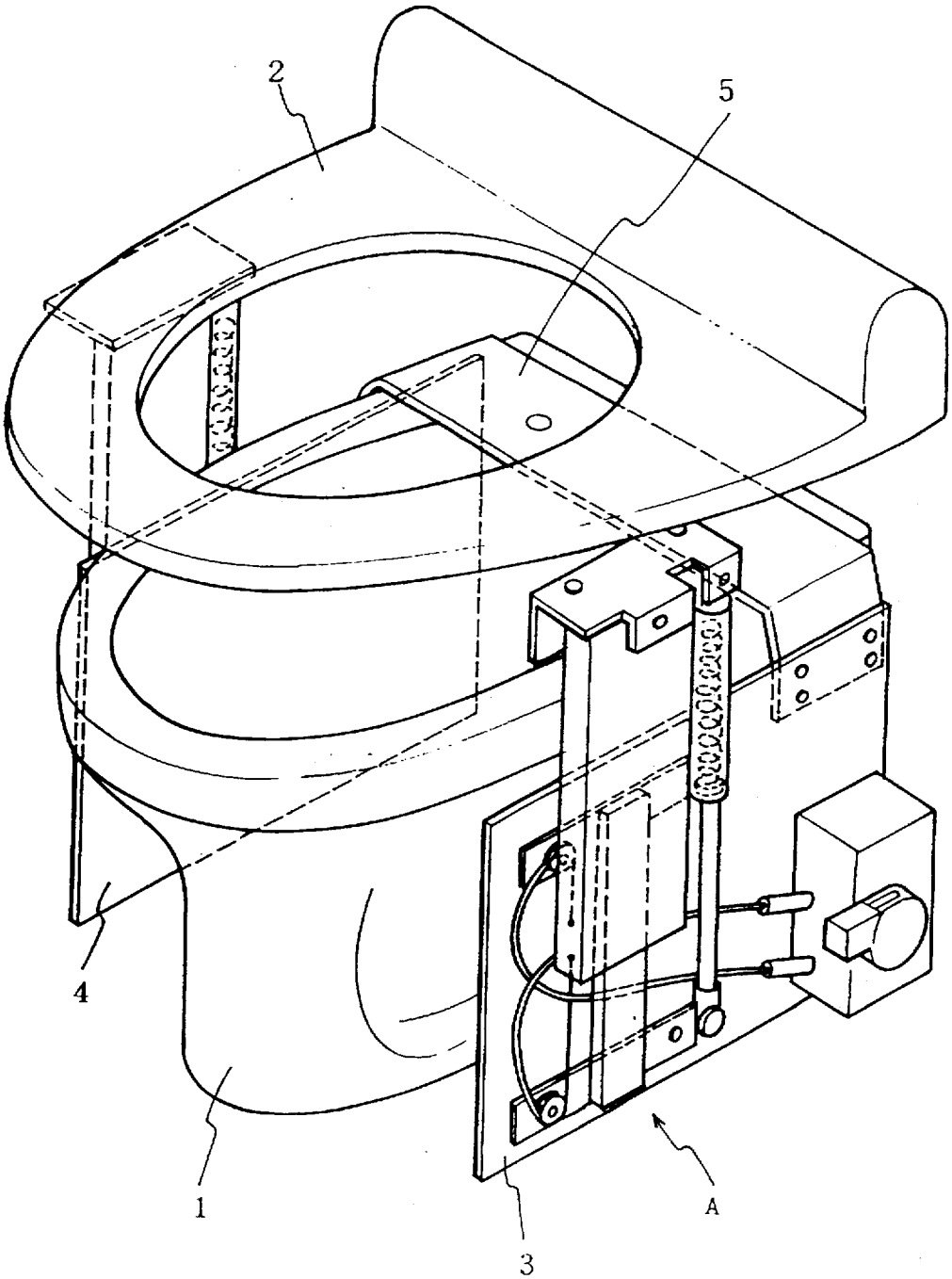
FIG. 1 is a perspective view showing an embodiment of a seat-lifting device of the present invention in such situation that the device is attached to a stool.

Referring to FIG. 1, reference number 1 denotes a stool. Reference member 2 denotes a seat, or a seat with washing device by warm water, for the stool. On both lateral sides of the stool 1, there are a right lifting unit (right unit) 3 and a left lifting unit (left unit) 4, respectively. The set of units 3, 4 are embodiment of the device of the present invention. Cases or covers are omitted in FIG. 1. Height of the lifting unit 3, 4 is the same as the stool 1 or slightly lower than the stool 1. Those lifting units 3, 4 are jointed mutually through a connecting frame 5 at upper ends of rear portions thereof.

In the present embodiment, the connecting frame 5 is fixed to the upper surface of rear side of the stool 1 by means of screws or the like. The connecting frame 5 is a member for making the whole device A into an inverse-U shaped assembly. Therefore, each unit does not fall outside when the seat 2 receives a load, e.g. when a user sits on the seat 2. However, the connecting frame 5 can be omitted on demand, for example, when the lifting units 3, 4 are fixed to a floor or the stool 1 by another means.

Figure 2:
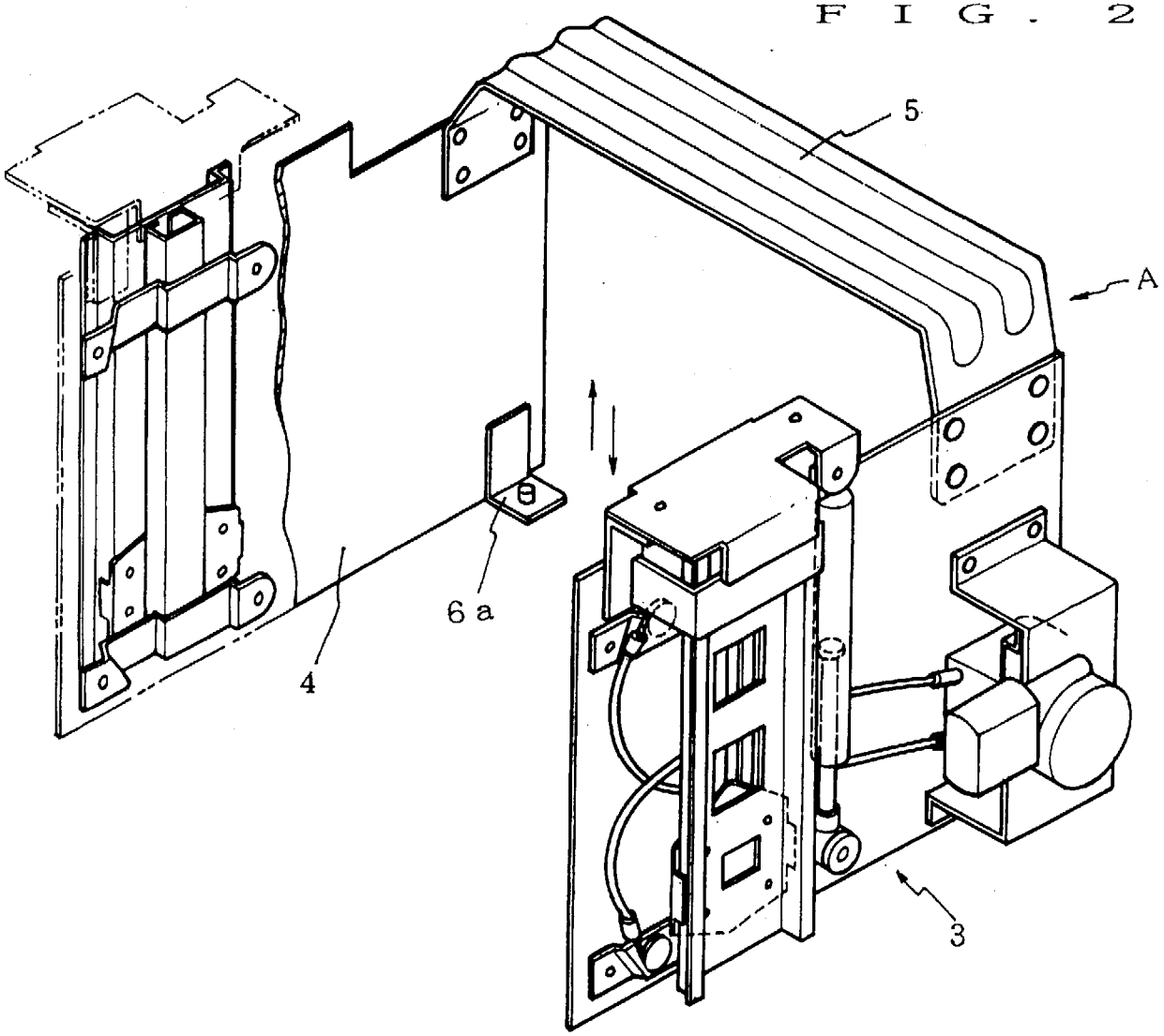
FIG. 2 is a perspective view showing the device alone.

Generally, a suitable length of the connecting frame 5 can be prepared according to the size of the stool. Beside, a connecting frame adjustable in length can be employed. The device A is shown in FIG. 2 without stool in detail. The left unit 4 is the same as the right unit 3 substantially, and the left unit 4 can be assembled from the same parts and symmetrical parts as the right unit 3.

Therefore, referring to FIG. 3, only the right 3 unit will be explained hereinafter, and detailed explanation about the left unit will be omitted.

Figure 3:
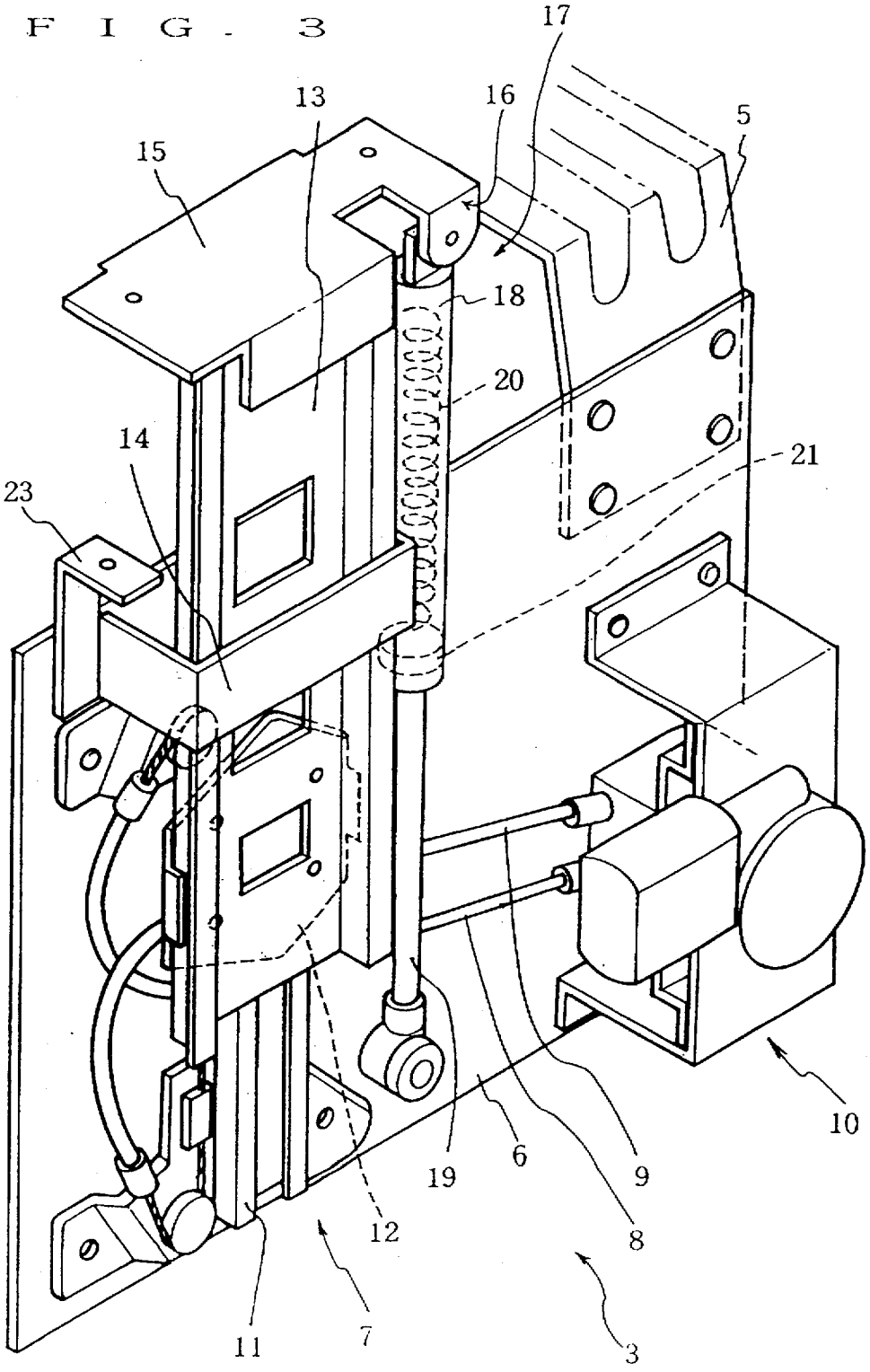
FIG. 3 is an enlarged perspective view showing the right hand unit of the device.

The right unit 3 in FIG. 3 has a base plate 6 made of a flat metal sheet which is set vertically on a floor so as to extend in the front-rear direction of the stool 1. A lifting portion or guide portion 7 is attached on the outer side of the base plate 6. An actuating portion or cable-driving portion 10 for actuating the lifting portion 7 through a pair of pull control cables (Bowden cables) 8, 9 is also attached on the outer side of the front of the base plate 6. And the cable-driving portion 10 is arranged at the rear side of the base plate 6.

Figure 11:
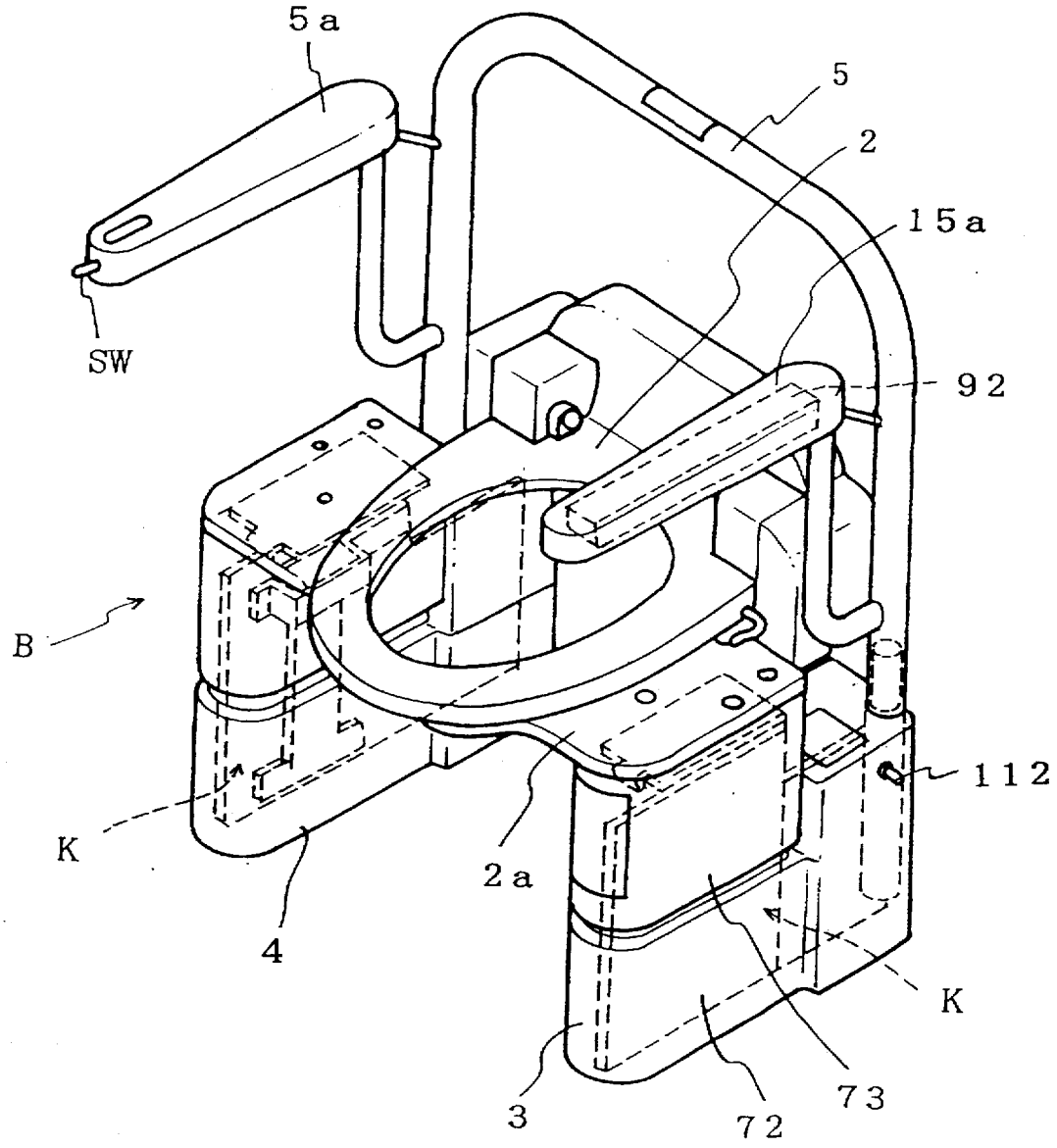
FIG. 11 is a perspective view showing another embodiment of a seat-lifting device of the present invention in such situation that the device is fully assembled.
Figure 12:
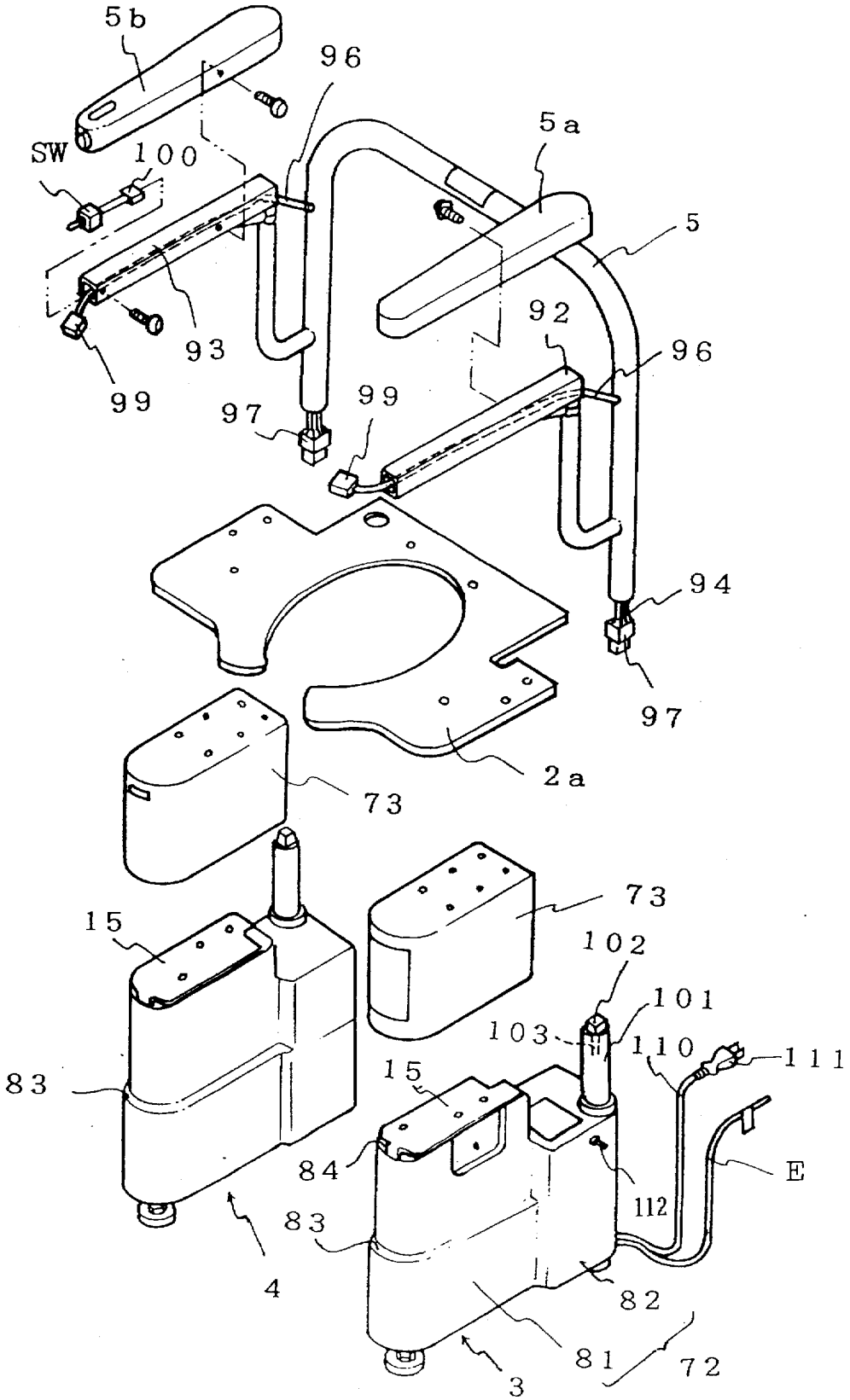
FIG. 12 is a perspective view showing the device of FIG. 11 before assembly.

Though the lifting portion 7 and the cable-driving portion 10 are coverd with covers or cases in the actual device as shown in FIGS. 11 and 12, those covers are omitted in FIG. 1 and the like. The base plate 6 can be directly laid on the floor. However, supporting legs such as leveling bolts (6*a* in FIG. 2) might be preferably employed.

The lifting portion 7 has a guide rail 11 attached on the base plate 6 so as to extend in the vertical direction, a carrier plate 12 mounted on the guide rail 11 so as to move along the guide rail 11, a sliding plate 13 having a lower end fixed to the carrier plate 12, and a guide frame 14 having C-shaped plan view for guiding the sliding plate 13. The sliding plate 13 is provided with a seat-supporting member 15 as a seat-supporting portion, at the upper end thereof. The seat-supporting member 15 is a member for supporting the seat at left or right end thereof. Then the middle areas in the front-and-rear direction at the left and right ends of the seat 2 are supported with the left and right seat-supporting members 15 and the sliding plates 13.

The seat-supporting member 15 has a rear end which is bent in the lower side, and the bent portion is used as a bracket 16 for supporting a gas spring 17. The gas spring 17 which is one of compression springs is attached to the bracket 16 by hanging a cylinder bottom, i.e. the upper end of the cylinder 18 in FIG. 3. A rod 19 of the gas spring 17 extends downward, and the free end of the rod 19 is pivoted to a lower portion of the base plate 6. The gas spring 17 has a cylinder 18 filled with a compressed gas such as nitrogen gas and/or a coil spring 20. The rod 19 is slidably inserted in the cylinder 18 so as to be extendable by virtue of difference of pressure between the inside of the cylinder and the outside. The rod 19 has a piston 21 at the inside end thereof. The piston 21 is slidably housed in the cylinder 18.

In general case, there is provided a passage for connecting one of rooms in the cylinder 18 separated with the piston 21 to anothey room. The passage or a flow resistant element inserted in the passage provides a damper and cussion effect. The passage can be an orifice formed in the piston. When a flow regulating valve is used as a flow resistant element, the flow resistance can be easily regulated. A coil spring 20 can be inserted in the sylinder 18. Further, a compression coil spring solely, a gas cylinder connected with a gas accumulator, and the like can be employed as an urging means.

Figure 5:
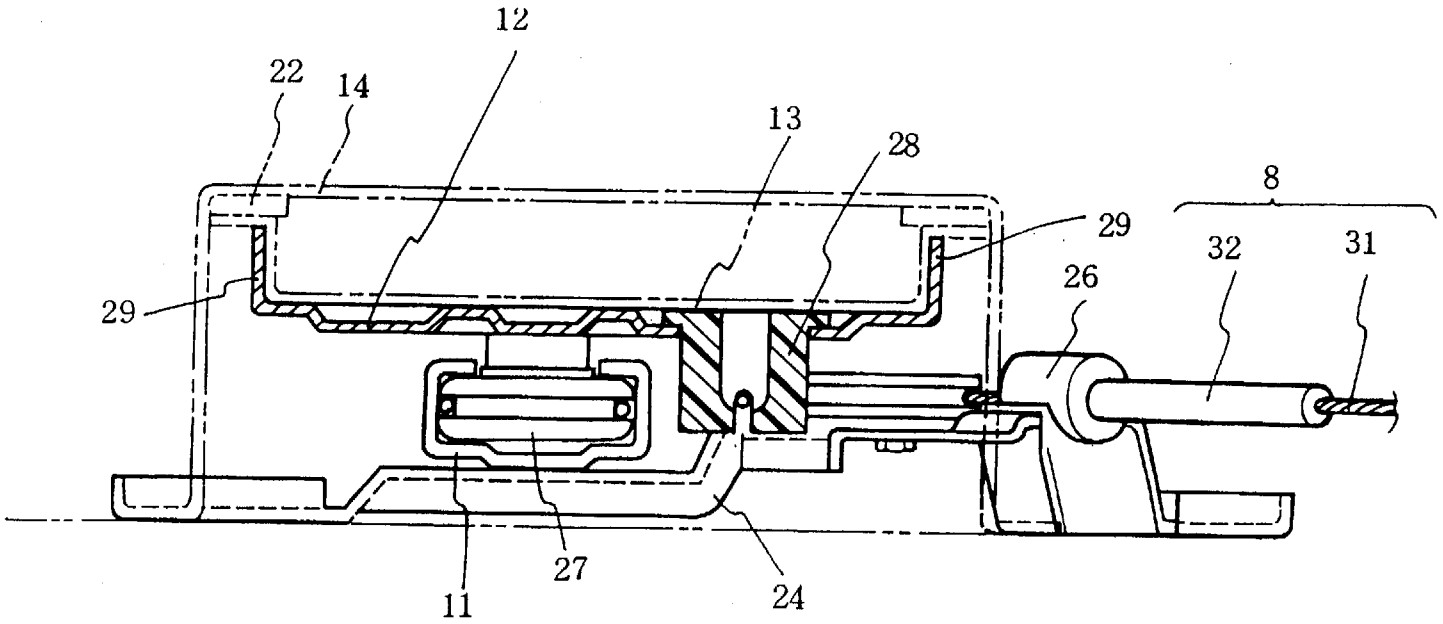
FIG. 5 is an enlarged sectional view along line V—V in FIG. 4.
Figure 7:
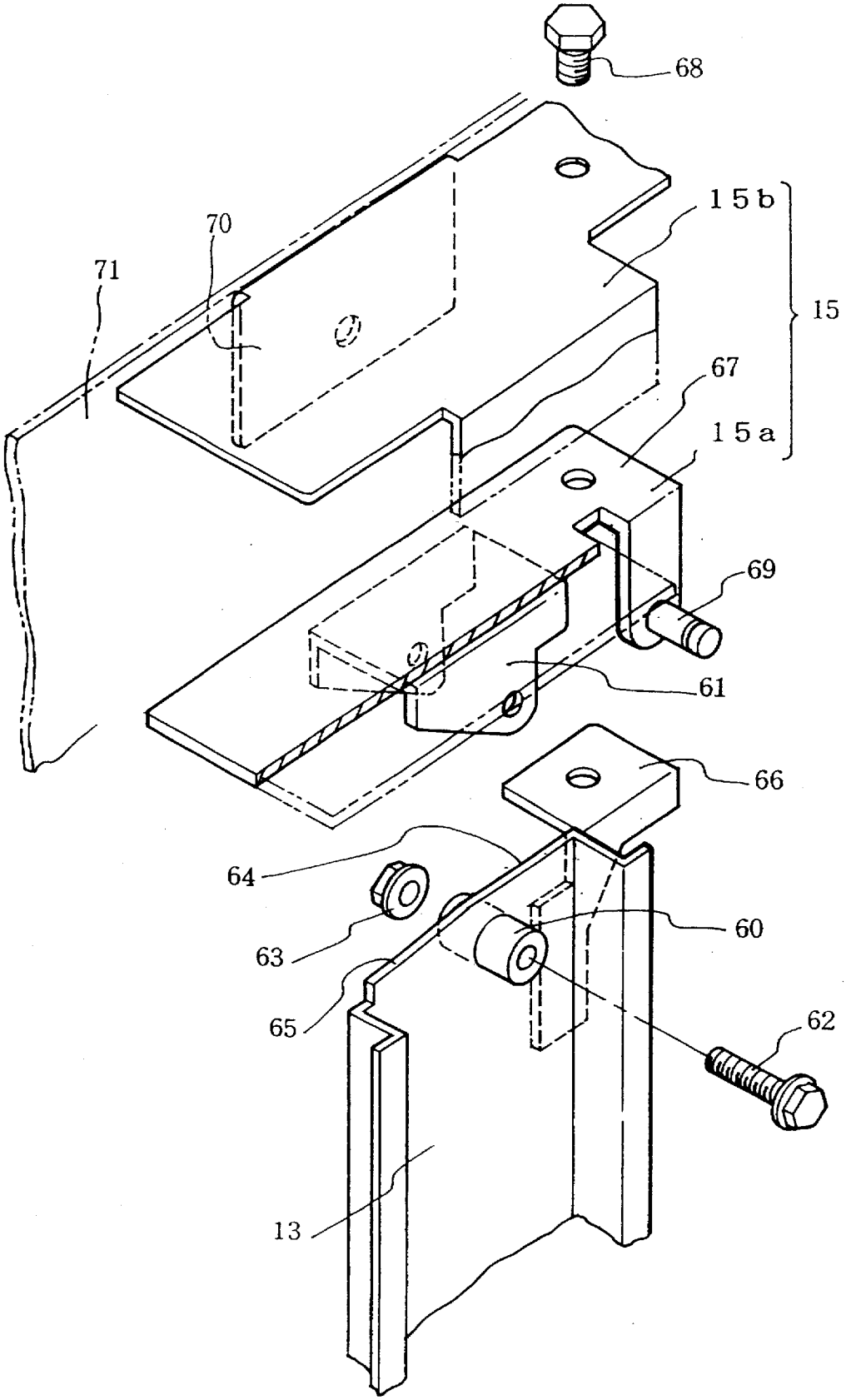
FIG. 7 is an enlarged perspective view showing a disassembled tilting mechanism of the device.

Referring to FIG. 5, the guide frame 14 is made by bending a metal sheet into a C-shaped plan view. The guide frame 14 has a liner 22 for slidably guiding the outer face of the sliding plate 13. The liner 22 is preferably made of synthetic resin by molding on a metal sheet, for example. The sliding plate 13 also can be made by bending a metal sheet into C-shaped in cross section as shown in FIG. 5 and FIG. 7. The guide frame 14 has a front end extending upward and bent outside. The bent portion is a stopper or a receiving portion 23 to which front under surface of the seat-supporting member 15 abuts when the seat 2 descends to the bottom (see FIG. 3).

Figure 4:
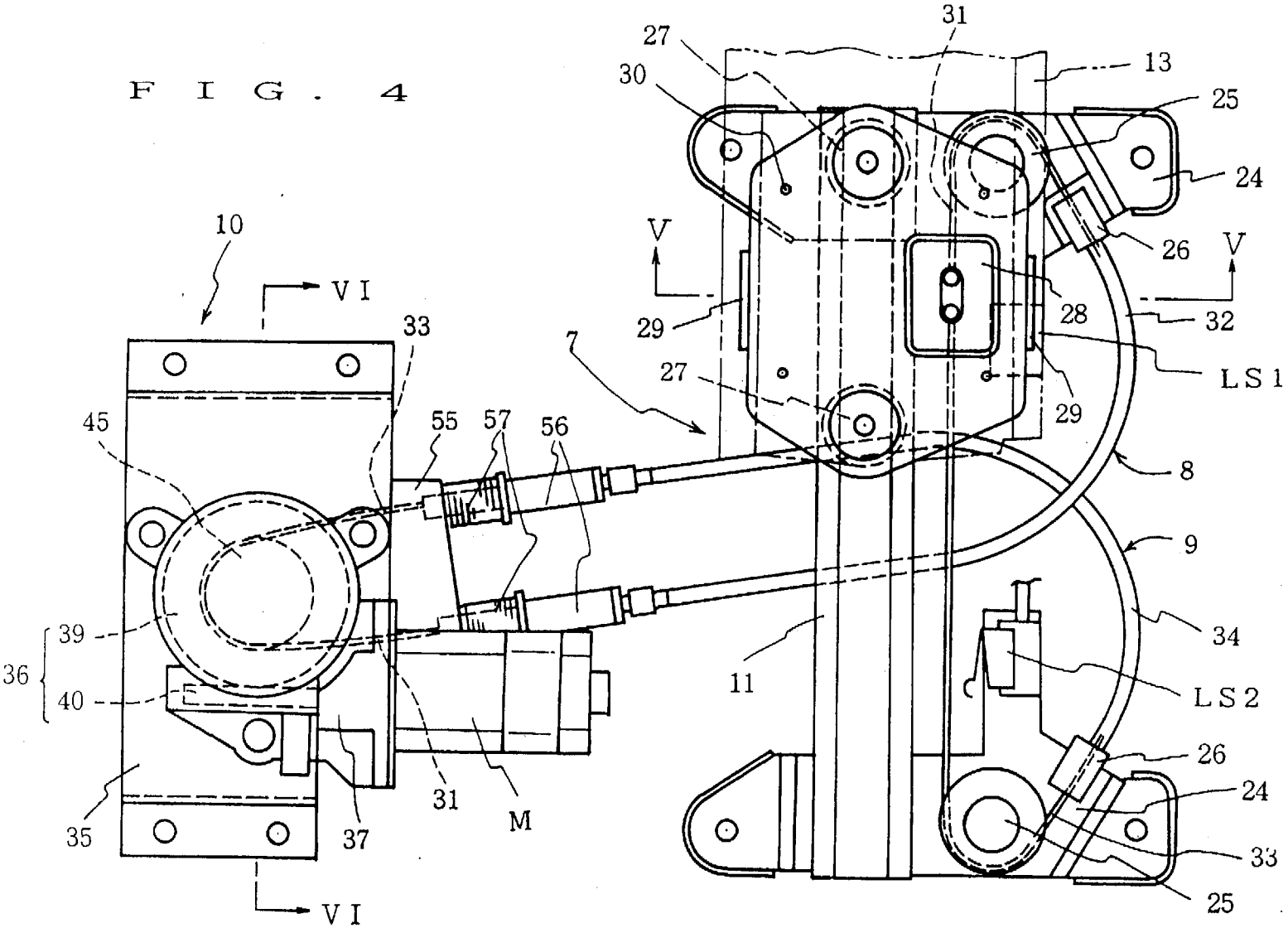
FIG. 4 is an enlarged side view showing the left hand unit of the device.

FIG. 4 shows in detail a part of the above-mentioned lifting portion 7 and the cable-driving portion 10. FIG. 4 shows a mechanism in the left unit 4 in FIG. 2. However, excepting seat-supporting member 15, the mechanism can be employed even for the right hand unit 3, by turning the sliding plate 13 upside down. That is to say, in the embodiment, the sliding plate 13 is symmetrically formed with respect to a center plane in the vertical direction. It is well understood by turning the drawing upside down. The sliding plate 13 therefore can be used for either side of units 3 or 4.

As shown in FIG. 4 and FIG. 5, the guide rail 11 in the lifting portion 7 can be obtained by bending a metal sheet into C-shaped cross section. The guide rail 11 has brackets 24, 24 for attaching the guide rail 11 to the base plate 6, at the upper and lower ends thereof. Each bracket 24 can be made of a metal sheet. The upper bracket 24 and the lower bracket 24 are symmetric mutually. Therefore, the guide rail 11 with the brackets 24 can be used either in the left unit 4 or the right unit 3.

A pulley 25 is rotatably attached to the outer surface of each bracket 24 as a means for changing direction of the cable. The pulleys 25, 25 can be omitted on demand. However, in such case that the pulley 25 or another guide member is omitted, the conduits 32, 34 of the control cables 8, 9 should be extend upward and downward and forcibly curved. If so, the cable 31, 33 is not easily driven, and the arrangement occupis large space. Therefore, it is preferable to employ a means for changing direction such as a pulley or a guide for slidably guiding a cable. Each cable 31, 33 is an inner cable of the control cable 8, 9 or so called Bowden cable.

Limit switches LS1 and LS2 for detecting the upper end and the lower end of the seat lifting motion are attached to the above-mentioned bracket 24, 24. Further, each bracket 24, 24 is provided with a portion 26 for fixing an end of conduit 32, 34 of the control cable 7, 8 so as to face to the pulley 25. As mentioned in FIG. 5, guide rollers 27, 27 are rotatably attached to the upper portion and the lower portion of the carrier plate 12. The guide rollers 27, 27 are engaged with the inner surface of the guide rail 11 so as to guide the motion of carrier plate 12 along the guide rail 11. Further, the carrier plate 12 has a cable-anchoring portion 28 made of synthetic resin, and has a lectangular parallelepiped form to project toward front side on the metal base of the carrier plate 12. The carrier plate 12 has left and right bent portions 29 at both side ends. The carrier plate 12 is mounted on the sliding plate 13 so as to embrace the sliding plate in the bent portions 29. The carrier plate 12 is then fixed to the sliding plate 12 by means of four screws 30 or the like.

As shown in FIG. 4, an ascending cable 31 is engaged with the cable-anchoring portion 28 at an end thereof. Then, the ascending cable 31 is extended upward. Further, the cable 31 is engaged with a groove of the upper pulley 25 so as to be turned down. Then, the cable 31 is inserted in a flexible conduit 32 of the control cable 8, and is guided to a cable-driving portion 10.

Beside, an end of another cable 33, i.e. descending cable is anchored with the cable anchorring portion 28. The cable 33 is extended downward, turned to upward, and guided to the cable-driving portion 10 by means of a conduit 34 of another control cable 9. In the lifting portion 7, each end of the conduit 32, 34 is fixed to the conduit-attaching portion 26 in the above-mentional bracket 24.

The cable-driving portion 10 has a C-shaped bracket 35 fixed to the base plate 6. A worm reduction gear 36 is attached on the outer surface of the bracket 35. An electric motor M is fixed to a housing 37 of the reduction gear 36. An output portion 38 is attached to the back side of the bracket 35. In the housing 37 of the reduction gear 36, a worm wheel 39 and a worm 40 are rotatably housed so as to mesh mutually. An output shaft of the motor M is connected to an end of the worm 40.

Figure 6:
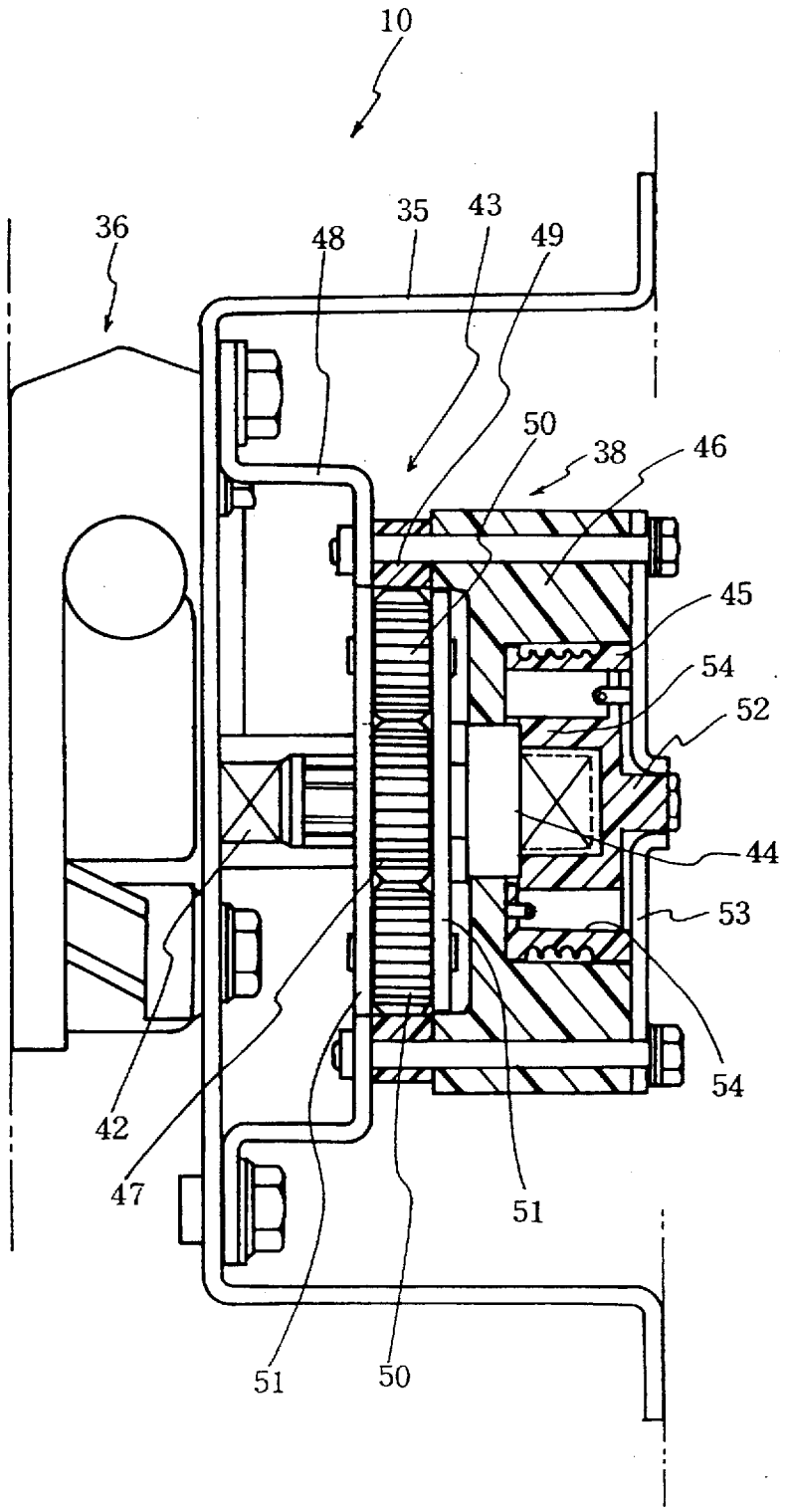
FIG. 6 is an enlarged sectional view along line VI—VI in FIG. 4.

Referring to FIG. 6, the output portion 38 has a planetary gear reduction assembly 43, a cable drum 45 fixed to an end of an output shaft of the planetary gear reduction assembly 43 and a drum housing 46 for housing the cable drum 45. The planetary gear reduction assembly 43 has a sun gear 47, a ring gear 49 concentrically arranged with the sun gear 47 and fixed to a spacer bracket 48, a set of planetary gears 50 interposed between the sun gear 47 and the ring gear 49, and a carrier 51 for rotatably supporting the planetary gears 50, so that the planetary gears 50 can rotate around there own axes. The carrier 51 has an output shaft 44.

The output shaft 44 is rotatably supported with the drum housing 46 so that the carrier 51 can rotate for revolution of the planetary gears 50. The cable drum 45 is fixed to an end of the output shaft 44 so that the cable drum 45 rotates togehter with the output shaft 44. A shaft portion 52 projecting from the cable drum 45 is rotatably supported with a cover 53 for closing an opening of the drum housing 46.

The cable drum 45 has a pair of holes 54 for anchoring the ends of the cables 31 and 33, and the drum 45 has a helicoid guide groove formed in the peripheral surface thereof. The drum housing 46 is provided with two conduit-attaching portions 55, and a conduit end member 56 is slidably inserted in each conduit-attaching portion 55. A spring 57 for absorbing elongation of the cable 31, 33 which arises during use, is interposed between the conduit-attaching portion 55 and a step portion in the conduit end member 56. The set of cable driving portion 10, the cables 31, 33 and the pulleys 25 corresponds an actuating mechanism in claims.

The above-mentioned actuating mechanism and the lifting portion 7 has the same construction as a cable-type window regulator employed in an automobile, and therefore the same function can be obtained. However, the reduction ratio in the actuating mechanism is larger than the window regulator, so that the actuating mechanism can lift up a relatively heavy load.

In the above-mentioned actuating mechanism, when the motor M rotates in a direction, the drum 45 is driven and rotated at a speed reduced through the worm reduction gear 36 and the planetary gear reduction assembly 43. One of the cables, e.g., the ascending cable 31 is wound around the drum 45, and another cable, e.g. descending cable 33 is unwound from the drum 45. Therefore, a loop of cable formed by the two cables 31 and 33 is circulated in a direction, and the ascending cable 31 pulls up the carrier plate 12.

Beside, when the motor M rotates to drive the drum 45 in the counter direction, the descending cable 33 is wound around the drum 45 to pull down the carrier plate 12.

Hereinafter, referring to FIG. 7, the seat tilting mechanism will be explained. In the present embodiment, the sliding plate 13 is pierced by a boss 60 at the upper portion thereof, and the boss 60 is fixed to the sliding plate 13 there. A U-shaped bracket 61 which is a lower portion of the seat-supporting member 15 is rotatably mounted on the boss 60 by means of a pin or an axis bolt 62 and a nut 63. Both seat-supporting members 15 of the left unit 4 and the right unit 3 are rotatable around a common imaginary axis for rotation. Therefore, the seat 2 which is bridged on the pair of left and right seat-supporting members 15 is rotatably supported with two portions separated with relatively long span or distance. Therefore, the tilting function is stable and smooth.

The upper end of the sliding plate 13 is cut off at the front half area 65 by a slanting plane at about 6 degrees with remaining the rear portion 64 as a horizontal plane. The angle of the cut off portion determines the tilting angle of the seat 2 and the seat-supporting member 15. Further, a plate 66 for keeping horizontal posture of the seat 2 is attached to an upper rear end of the sliding plate 13. The rear end of the seat-supporting member 15 is detachably connected with the keeping plate 66 by means of a keeping screw 68. The set of the keeping plate 66 and the keeping screw 68 is a means for keeping horizontal posture of the seat 2.

Besides, in the present embodiment, the seat-supporting member 15 has a main part 15*a* made of a thick metal plate and a cover 15*b* mounted on the main body 15*a*. The cover 15*b* is made of a thin metal sheet. The cover 15*b* has a bent piece 70 which is bent downward at the outside of the base plate 6. The bent piece 70 is a portion for rotatably hanging a sliding panel or sliding cover 71. The sliding panel 71 is a sheet for covering an upper end opening of the lifting portion 7, even if washing water is erroneously discharged when the seat 2 goes up. The sliding panel 71 is arranged in a gap between the base plate 6 and the stool 1 so that the sliding panel 2 can ascend and descend. The upper end of the sliding panel 71 is rotatably hung on the above-mentioned bent piece 70 by means of a rotary shaft which is almost concentric with the axis bolt 62 for seat-supporting member 15 in order not to disturb the tilting motion of the seat 2. The reference number 69 denotes a pin for engaging the gas spring 17.

Figure 8:
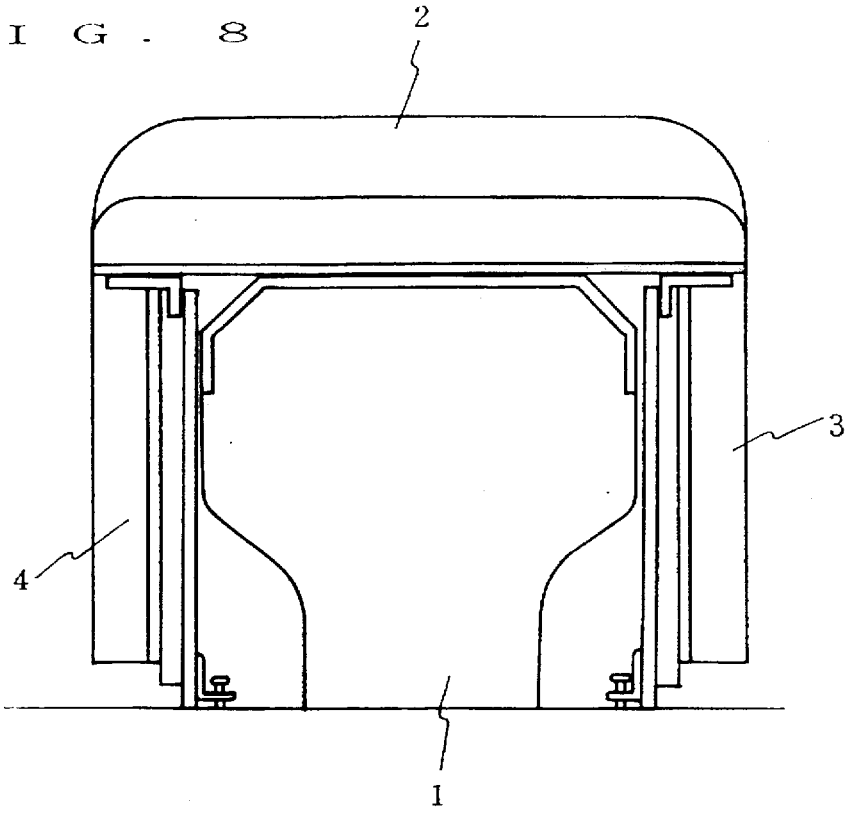
FIG. 8 is a schematic front view of the device attached to a stool.
Figure 9:
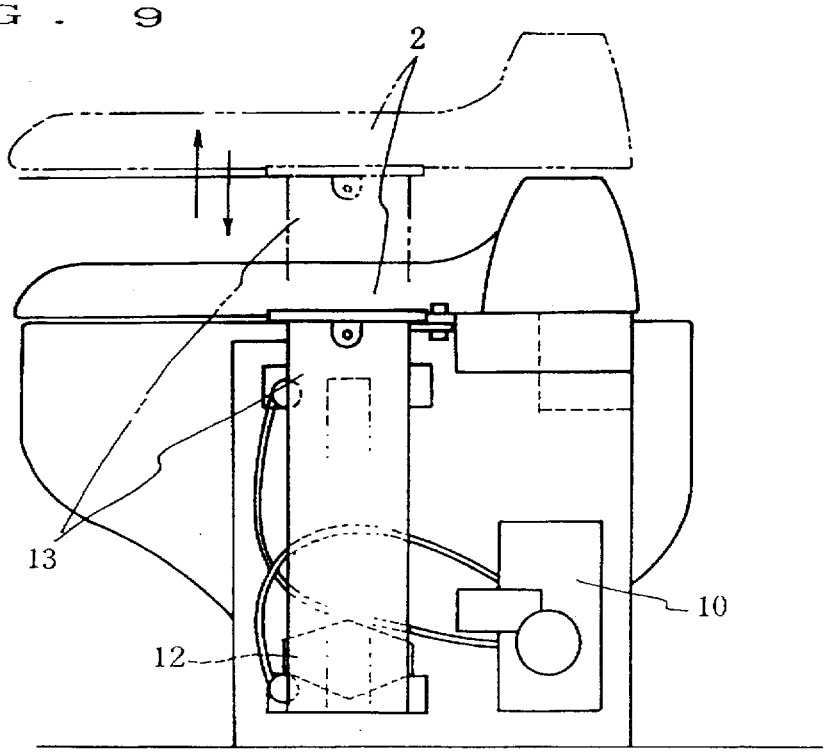
FIG. 9 is a schematic side view of the device attached to a stool.

As shown in FIG. 1, FIG. 8 and FIG. 9, the above-mentioned seat-lifting device A is mounted on a stool 1 so as to stride on the stool 1. A ring-like seat 2 is attached securely on the pair of seat-supporting members 15 at the left and right side ends and middle portions in the front-and-rear direction. Therefore, though the center of the seat 2 is empty, weight of user can be directly supported by the lifting portions 7, and the weight is pressed up straightly. Therefore, the guide rails 11 and the like do not receive large bending moment, and huge strength is not required for the parts of the device A. This is one of reasons that the device can be made in small size.

Though a seat 2 with washing device by warm water is shown in the drawings, a normal seat of course can be employed. Further, a stool cover or a static seat (not shown in drawings) and a normal seat having a rear end rotatably attached to the stool cover can be employed as a cover to be mounted on the seat-supporting members. In this case, the combination of the stool cover and the rotatable seat is "a seat" in claims.

In FIG. 9, there is shown a horizontal operation mode where the seat-supporting member 15 is fixed to the keeping bracket 66 by means of a keeping screw, and the seat-tiling mechanism is not effective. In this mode, the seat 2 moves up and down with keeping horizontal posture, In this case, when the cable-driving portion 10 actuates to pull the ascending cable 31 and to send the descending cable 33, the carrier plate 12 rises up and the sliding plate 13 fixed to the carrier plate 12 also rises up. Then, the seat 2 rises with keeping horizontal posture. Beside, when the cable-driving portion 10 actuates in the counter direction, the carrier plate 12 and the sliding plate 13 go down with keeping horizontal posture.

In general case, though the sliding plate 13 is usually urged upward by means of the gas spring 17, ascending motion of the sliding plate 13 is controlled by the descending cable 33 since reduction gears in the cable-driving portion 10 serves as a brake. And when a user sits on the seat, the user's weight can be supported with the gas spring in part. Therefore, the power of cable is balanced between the ascending and descending, and required power is saved and is not largely changed during the up-and-down motions of the seat.

Figure 10:
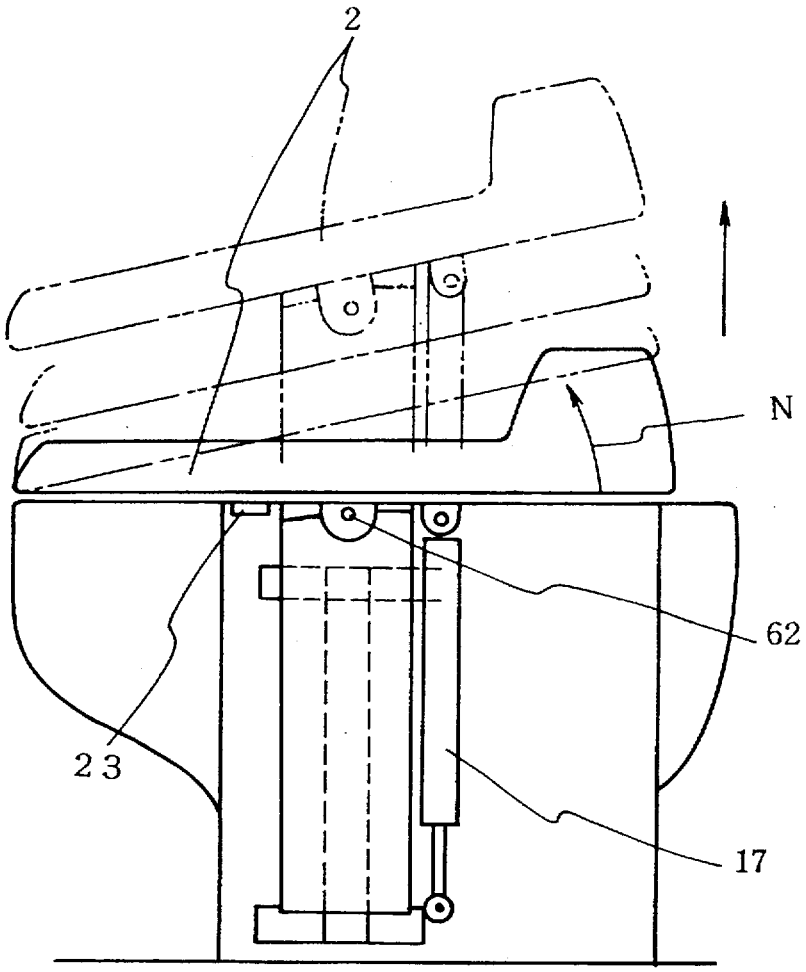
FIG. 10 is a schematic side view showing the device attached to a stool in another situation.

Next, referring to FIG. 10, a tilting operation mode without keeping screw 68 is explained. In this mode, as the seat 2 goes up, the seat 2 gradually tilts to the front side around the axis bolts 62 in the left and right units 3,4 as shown by arrow mark N since rear portion of the seat 2 is pressed up due to the urging force of the gas spring 17 in general case. However, if the user sits on the most rear portion of the seat 2, the seat may not tilt to the front side.

After the front end of the seat-supporting member 15 departs from the receiving portion 23, the tilted seat 2 is pressed up with keeping the tilted posture. Therefore, the user can easily rise from the seat 2. Further, the user can easily sit on the seat 2, since the seat 2 is tilted to the front side. Then, the seat 2 descends with keeping the tilted posture.

When the seat 2 approaches the bottom position, the front end of the seat-supporting member 15 abuts against the receiving portion 23. Then, the front end of the seat-supporting member 15 stops, and only the rear side continues to descend. Therefore, the seat-supporting member 15 rotates to the rear side around the left and right axis bolts 62 to become a horizontal posture.

As mentioned above, the seat-lifting device A can be operated either in a horizontal mode where the seat tilting mechanism is not effective and in a tilting mode where the seat tilting mechanism is effective. And those two operation modes can be selected by the user on demand.

In the above-mentioned embodiment, the gas spring as a means for urging the seat upward serves also as a means for urging the seat to tilt to the front side. However, another urging means can be employed independently in the present invention. For example, as the means for urging the seat to tilt, a compression coil spring, an extension spring for pulling down the front side of the seat-supporting member 15, or a torsion spring can be employed.

Further, in a basic seat-lifting device, those seat-tilting mechanism and the selecting mechanism are not essential. That is to say, the seat-tilting mechanism can be usually effective in the present invention. Further a seat-lifting device the seat-tilting mechanism or a device without urging means can be employed on demand.

In the above-mentioned lifting device A, there is no obstacle over the stool 1 when the seat 2 comes to the bottom, since the lifting portions 7 and the cable-driving portions 10 are arrange at the sides of the stool 1 such that the seat 2 can be pressed up from the lower side of the seat 2. Further, there is no obstacle over the seat 2 when either the seat 2 goes up or down. In addition, each of the left unit 4 and the right unit 3 of the device A can be situated in a narrow and thin area along the stool 1.

Therefore, the lifting device A is familiar and convenient for not only a physically handicapped person, but also a normal person. Further, since the lifting portion 7 can be set on the position near the stool 1, the lifting portion 7 does not receive any large bending moment.

In the above embodiment, the left and right cable-driving portions 10 are not precisely synclonized mutually during the up-and-down motion. However, there is no problem, since the upper end and the bottom end of the sliding plate 13 can be detected by means of limit switches (LS1 and LS2 in FIG. 4), and then, the seat 2 can be held in a horizontal posture in the right-and-left direction when the seat 2 comes to the upper end and the bottom end. Of course, means for electrically synclonizing the motions of the left and the right cable-driving portions can be employed, in the device. For example, a means for detecting positions in height such as magnetic sensor or photo-sensor and a pair of motors which can be precisely controlled in rotary angle such as a pulse motor can be used as a synclonizing means. Further, since the flexible conduits are used for guiding the cable, those cables can be arranged between the left and right unit. In this case both left and right cables can be driven by one cable-driving portion, for example, which has one or two drums for driving both cables coincidently and which is set in one of the lifting unit.

In the above-mentioned embodiments, cables and a cable-driving mechanism are employed as a means for changing the rotation of motor into a linear motion of the sliding plate. However, in the first aspect of the present invention, another motion change mechanism such as a set of teeth or a rack and a pinion can be employed. In this case, the sliding plate can be directly driven without control cables. In this embodiment, there is also obtained function and effects that there is no obstacle over the seat and the driving mechanism is simple.

In the second aspect of the present invention, it is not necessary to divide the lifting portion into left and right unit. That is to say, a lifting portion which is situated on the rear end or the upper side of a stool. Such device does not provide any merit that obstacle over the seat is removed. However, whole mechanism can be formed in a compact and small size by virtue of the flexible control cable, and smooth up-and-down motion can be obtained. In addition, in both aspects of the device, if a means for urging the seat-supporting portion, the difference of the driving force between the ascending motion and the descending motion can be descended, and smooth motion can be obtained. Further, the speed of motion is averaged and good durability can be obtained. In an embodidment in which a gas cylinder is employed as an urging means, even if the cable breaks, the seat does not falls down rapidly.

The sliding plate 13 is straightly guided in the up-and-down direction, and the seat-supporting member is rotatable to the sliding plate, in the above-mentioned embodiments. However a guide rail or guide rails which have upper portions curved to the front side can be employed. In this case, the carrier plate 12 and the sliding plate 13 are tilted to the front side as they come upward.

As understood from the above-mentioned embodiments, the basic features of the first aspect of the invention is to provide a left unit and a right unit, each unit having a guiding mechanism and a driving mechanism, at both side of a stool, so that there is no obstacle over the seat.

That is to say, in conventional electric powered lifting devices, a rotary shaft is extended between a left guide and a right guide. Therefore, the rotary shaft has to be arranged at the rear end of a seat in order to avoid the center of the seat. Then, the seat is necessarily supported at the rear end thereof to form a canti-lever support. Therefore, a guide or guides are required to project from the upper surface of the stool.

In the first aspect of the present invention, no rotary shaft is extended between the left and right static guides and between the left and right moving members, and the left and the right units are separately driven. Therefore, the seat can be supported at center portions in the front-and-rear direction. And user's weight can be supported without canti-lever support. Further, simple guide mechanisms can be employed, and there is no projecting obstacle over the stool.

Hereinafter, another seat-lifting device B is explained with reference to FIG. 11 and FIG. 12. The device B is also one of the embodiments of the present invention. The device B has a set of separated units to be set around a stool (reference number 1 in FIG. 16) and to be assembled there. Therefore, the device B can be easily applied to an already used stool. Reference number 2 denotes a seat, especially a seat having a heater and/or a washing device by warm water. The device B is for providing a vertical motion of the seat 2 and a tilting motion of the seat 2 during the vertical motion.

The device B has a right lifting unit (right unit) 3 and a left lifting unit (left unit) 4 which are set on both sides of a stool closely, a supporting plate 2*a* attached on the units 3, 4, and a connecting frame 5 for mutually connecting rear ends of the units 3, 4. The connecting frame 5 is made of a pipe which is bent to form an inverse-U shape, in the present embodiment. Though the connecting frame 5 is one of structural members constituting whole device having an inverse-U form, the frame 5 also serves as a hand rail by which a user supports himself, a member for supporting arms 5*a* and a protecting pipe through which electrical wires or cords connecting the left and right units are inserted, in this embodiment.

The left unit 4 has the same construction as the right unit 3. Therefore, the right unit 3 solely will be explained hereinafter with reference to FIG. 13. The right unit 3 in FIG. 13 has a base plate 6, a lifting portion 7 and a cable-driving portion 10. Excepting tilting mechanism, the lifting portion 7 of the device B is the same as the lifting portion of the device A in FIGS. 1 through 6. Further, the cable-driving portion 10 of the device B is the same as the device A.

Therefore, the same portions are added with the same reference numbers, and detail explanation will be omitted. The lifting portion 7 and the cable-driving portion 10 are covered with a static cover 72 and a movable cover 73, as shown in FIG. 11 and FIG. 12. However, those covers 72 and 73 are omitted in FIG. 13, FIG. 14 and FIG. 15. Hereinafter, the tilting mechanism will be explained in detail.

Figure 13:
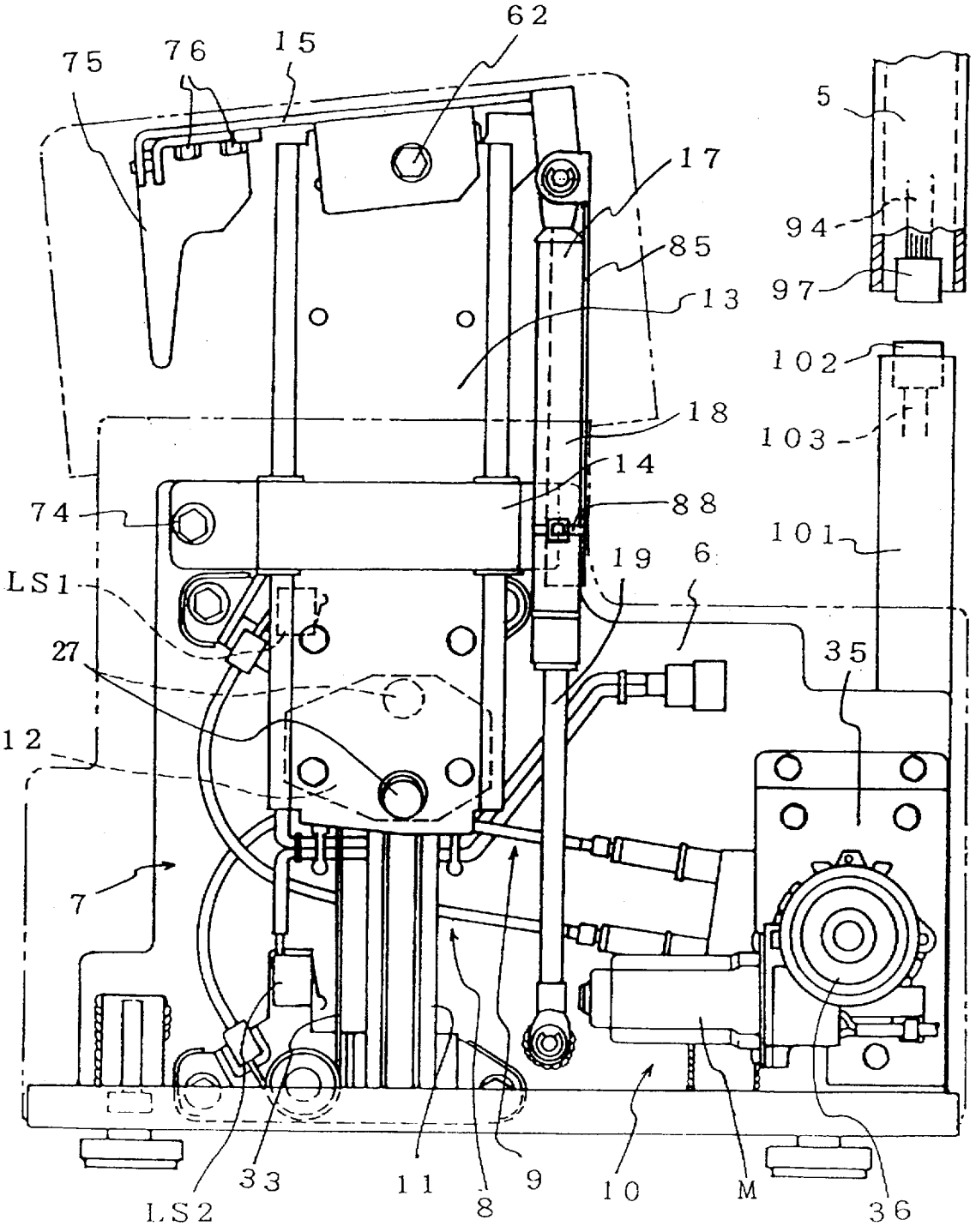
FIG. 13 is a side view showing an inside construction of right handed unit of the device.

Referring to FIG. 13, a cam roller 74 is rotatably attached on the left end of a guide frame 14. The cam roller 74 serves as a stopper for a seat-supporting member 15. A cam plate or cam member 75 is attached to the under surface of the seat-supporting member 15 at the front end thereof by means of screws 76 so as to cooperate with the cam roller 74. The cam roller 74 and the cam member 75 constitute a cam mechanism for providing a preferable tilting motion.

The cam member 75 has a base portion 75*a* and a plate-like abutting portion 75*b* which stands up from the end of the base portion 75*a*. The front end of the seat-supporting member 15 is bent down, and an adjusting screw 75*c* is screwed in the bent portion. The end of the adjusting screw 75*c* is abutted against the abutting portion 75*b* of the cam member 75. Therefore, the position of the cam member 75 can be adjusted in the front and rear directions by turning the adjusting screw 75*c* after the attaching screws 76 are released.

The cam member 75 has a cam surface 77 to cooperate with the cam roller 74 and a step-like stopper portion 78 continuing from the cam surface 77. The stopper portion 78 is substantially parallel with the base portion 75*a*. The cam surface 77 is slanted so that the front side goes down, and the angle between the stopper portion 78 and the cam surface 77 is slightly larger than a right angle plus the tilt angle of the seat-supporting member 15. Therefore, the cam surface 77 is slightly slanted backward so that the front side goes down, even if the seat-supporting member 15 tilts to the front side. Then, the cam roller 74 can abut to the cam surface 77 when the tilting seat-supporting member 15 comes down vertically.

Figure 15:
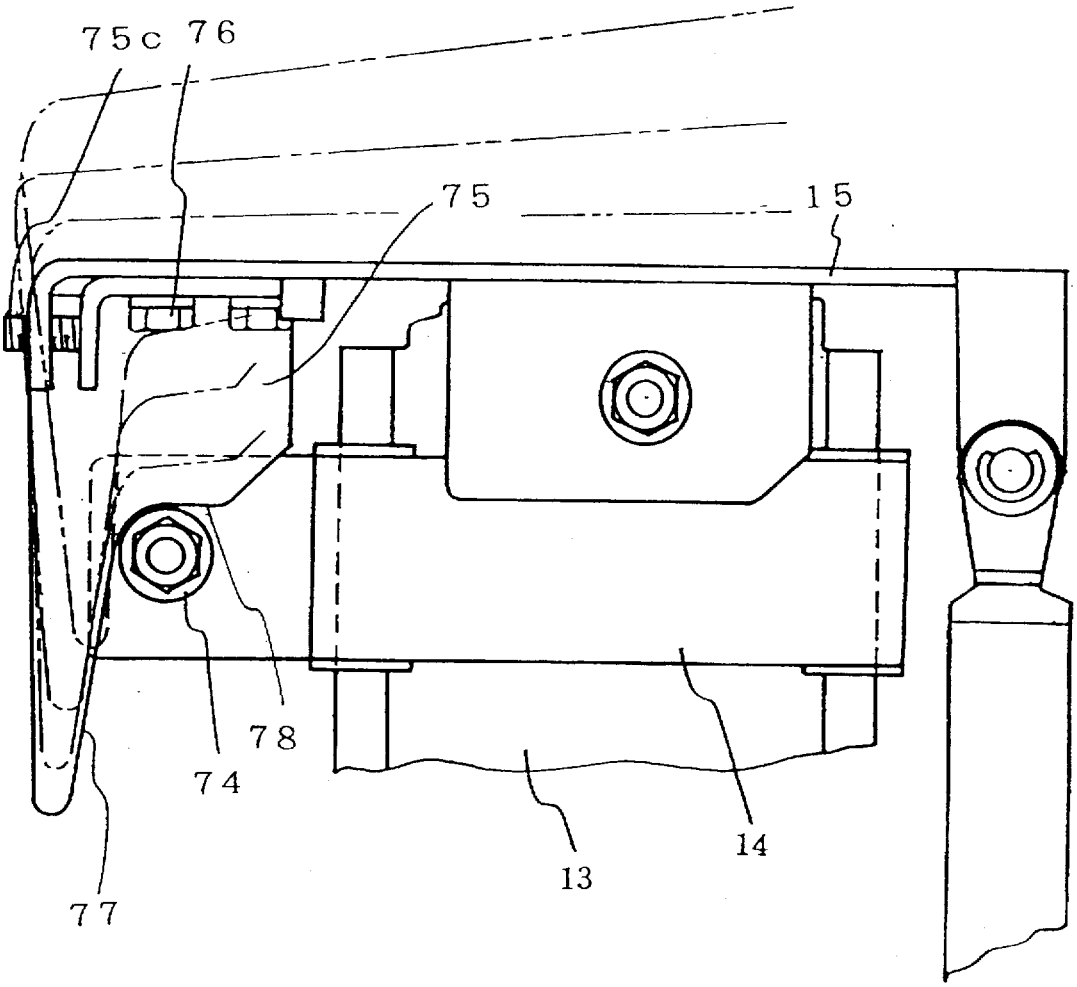
FIG. 15 is the same side view as FIG. 14 where the seat comes to the bottom position.

Beside, as shown in FIG. 15, the angle of the cam surface 77 to a vertical plane is relatively large when the stopper portion 78 becomes to abut against the cam roller 74, and the seat-supporting member 15 comes to a horizontal posture.

Figure 14:
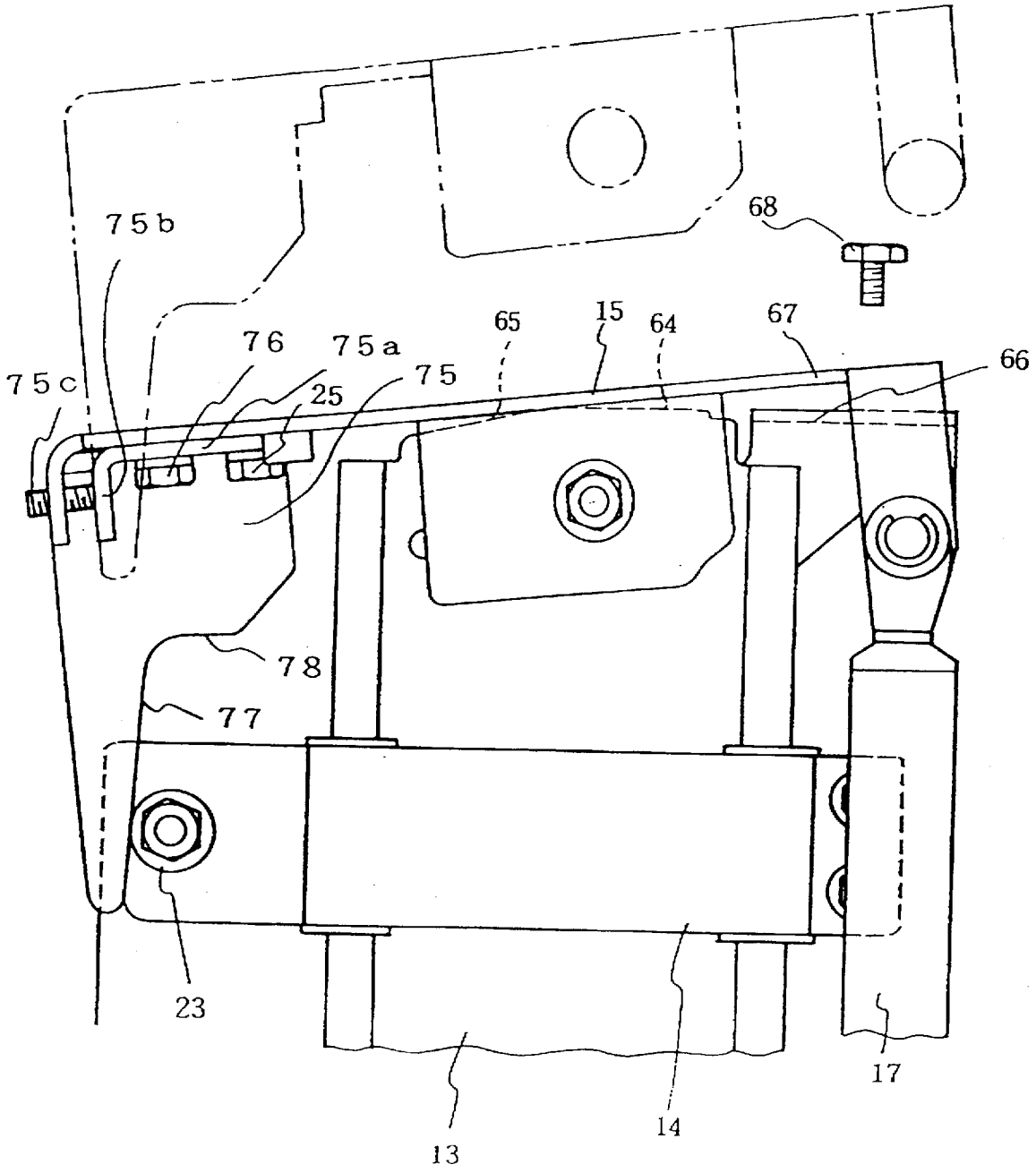
FIG. 14 is an enlarged side view showing a tilting mechanism in the device.

In the cam mechanism shown in FIG. 14, the seat-supporting member 15 is urged to rotate in the front direction, i.e. counter-clockwise, by a gas spring 17. Then since the cam surface 77 abuts against the cam roller 74, the seat-supporting member 15 does not rotate further. From this situation, when the sliding plate 13 goes down, the cam surface 77 abuts against the cam roller 74 at upper position thereof.

Therefore, the seat-supporting member 15 rotates clockwise in FIG. 14, since the cam surface 77 slants to the rear side so that the upper portion goes back, i.e. right hand side in FIG. 14. Then, as the seat-supporting member 15 approaches the bottom, it approaches a horizontal posture. Finally as shown in FIG. 15, the stopper portion 78 abuts against the cam roller 74 and comes to a horizontal posture.

As the seat-supporting member 15 goes up from the situation in FIG. 15 where the seat-supporting member 15 is at the bottom, the seat supporting member 15 gradually rotates in the front direction. That is to say, just after the start of upward motion, the seat-supporting member 15 shows an almost horizontal posture against the urging force in the counter clockwise due to the gas spring 17, since the upper side of the cam surface 77 abuts against the cam roller 74. And the cam member 75 ascends with being guided by the cam roller 74. As the lower portion of the cam surface 77 abuts against the cam roller 74, the cam member 75 and the seat-supporting member 15 rotates gradually counter-clockwise due to the urging force of the gas spring 17.

The seat-supporting member 15 goes up through the position shown in FIG. 14, and the bottom end of the cam surface 77 becomes disengaged from the cam roller 74.

After the cam member 75 is disengaged from the cam roller 74, the lower surface of the seat-supporting member 15 abuts against the front half 65 of the upper end of the sliding plate 13, and it does not rotate moreover. Imaginary line in FIG. 14 shows a state where the cam member 75 (and the seat-supporting member 15) comes up with keeping a predetermined angle after the disengagement from the cam roller 74.

When the cam member 75 goes down from the upper stroke end, the cam member 75 goes down with keeping the same predetermined angle till the cam surface 77 abuts against the cam roller 74. After the cam surface 77 abuts against the cam roller 74, the cam member 75 and the seat-supporting member 15 go down with rotating clockwise gradually to a horizontal posture.

As mentioned above, the starting point of tilting motion and returning motion of the seat depends on a position where the cam surface 77 comes to abut against the cam roller 74. Therefore, by regulating the position of the cam member 75, the starting position of tilting motion can be adjusted. For example, when the cam plate 75 is shifted to the right side by releasing the screw 76 and turning the adjusting screw 75*c*, the cam surface 77 becomes to be contact with the cam roller 74 at the higher position. That is to say, the starting point of the tilting motion becomes high. Beside, when the cam member 75 is shifted to the left side, the tilting motion starts at the lower position. Therefore, by regulating the front-rear position of the cam member 75, the hight where tilting motion starts can be easily adjusted. Thus, in the device B of FIG. 13 to FIG. 15, the tilt-starting position can be adjusted to a suitable height on demand of the user. Further, the tilt-starting positions of the left unit 4 and the right unit 3 can be precisely accorded mutually.

In the present embodiment, the stopper portion 78 of the cam member 75 is parallel with the base portion 75*a*. Therefore, the horizontal posture of the seat-supporting member 15 is not changed even the cam member 75 is regulated in the front-rear direction. However, another embodiment where the angle of the seat-supporting member 15 at the bottom end thereof is adjustable can be employed.

For example, when a stopper member which is separated from the cam member 75 and which has a slightly slanted abutting surface to the base portion is adjustably mounted on the lower surface of the the seat-supporting member 15, the angle of the seat in the bottom of stroke can be adjusted.

In the above-mentioned mechanism shown in FIG. 14, a plate 66 for keeping horizontal posture is attached at the rear upper end of the sliding plate 13, and the rear portion 67 is detachably jointed to the keeping plate 66 by means of a keeping screw 68 for keeping horizontal posture. That is to say, the posture-keeping mechanism shown in FIG. 7 can be employed even in this embodiment.

In this embodiment, in such condition that the seat-supporting member 15 is fixed to the keeping plate 66 by means of the keeping screw 68, the seat-supporting member 15 moves vertically with keeping horizontal posture. During the vertical motion, the seat-supporting member does not tilt to the front side. The cam member 75 does not touch the cam roller 74. Those cam mechanism does not interfere with the vertical motion of the seat-supporting device.

As a cam mechanism for providing tilt motion, a set of a grooved cam and a cam roller can be employed. However, such cam mechanism is not suitable for a seat-lifting device with the above-mentioned posture-keeping means, since the cam groove interferes with the vertical motion of the seat-supporting member when the seat is kept at the horizontal posture. Therefore, the cam mechanism using a cam member 75 with sole side cam surface 77 is suitably employed for the seat-lifting device with a posture-keeping means. If posture-keeping means is not required, the groove cam which has both contacting surface can be employed.

In the embodiment of tilting mechanism shown in FIG. 14 and FIG. 15, the cam roller 74 is attached to a static guide side (guide frame 14), and the cam member 75 is attached to the seat-supporting member 15. However, a contrary arrangement can be employed, for example, as shown in FIG. 18.

Figure 18:
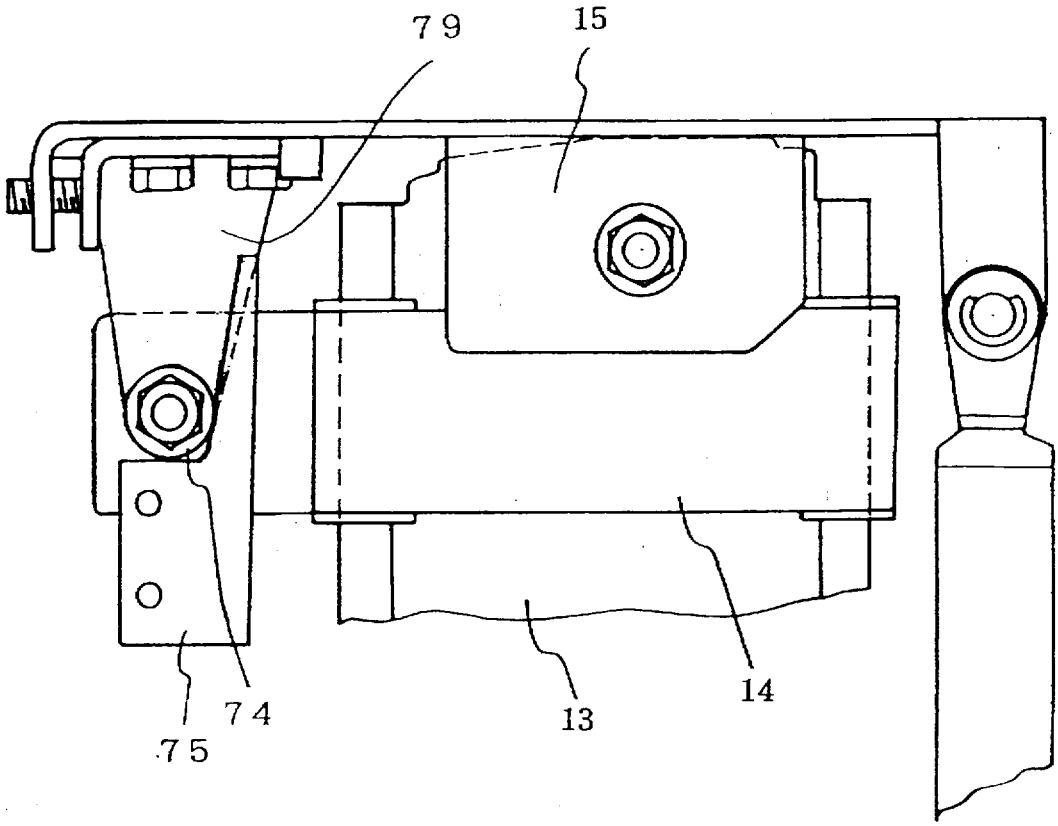
FIG. 18 is a side view showing another embodiment of a tilting mechanism in the present invention.

In the cam mechanism in FIG. 18, a cam member 75 is attached to a static guide, e.g. a guide frame 14, and a cam roller 74 is attached to the seat-supporting member 15 through a bracket 79. The position of the cam roller 74 is adjustable in the front-rear direction.

In this embodiment, as the sliding plate 13 descends, the seat-supporting member 15 descends with a determined tilting angle, and then returns to a horizontal posture gradually from the middle way. At last the seat-supporting member 15 becomes horizontal at the bottom of the vertical motion. Further, as the sliding plate 13 ascends, the seat-supporting member 15 rotates gradually in the front direction (clockwise in FIG. 18). Then, the seat 2 ascends with the same tilting angle from a middle way.

In the embodiment of FIG. 18, and in the embodiment of FIGS. 14 and 15, the cam member 75 can be easily changed. And when the cam member 75 is changed with another cam member which has another shape of cam surface 77, various locuses of tilting motion in the vertical motion can be obtained. The cam surface can be sufficiently extended in the vertical direction so that the cam roller abuts against the cam surface during the whole vertical motion. In this case the seat-supporting member tilts or returns further gradually in the whole vertical stroke, i.e. from the bottom through the upper end, and vice versa.

In the embodiment of FIG. 14 and FIG. 15, the cam member 75 is horizontally adjustable in the front-rear direction. And in the embodiment of FIG. 18, the cam roller 74 is also horizontally adjustable. However, in the both embodiments, the cam surface can be adjusted in the front-rear direction by moving the cam member 75 in the vertical direction, since the cam surface 77 is slanted. In those cases, the same function and effect as the cam mechanism in FIG. 14 can be obtained without moving the cam member in the front-rear direction. Further, more precise adjustment can be obtained since the cam surface is slightly slanted with respect to the vertical plane. In those cases, the stopper should be independent from the cam member 75.

Figure 16:
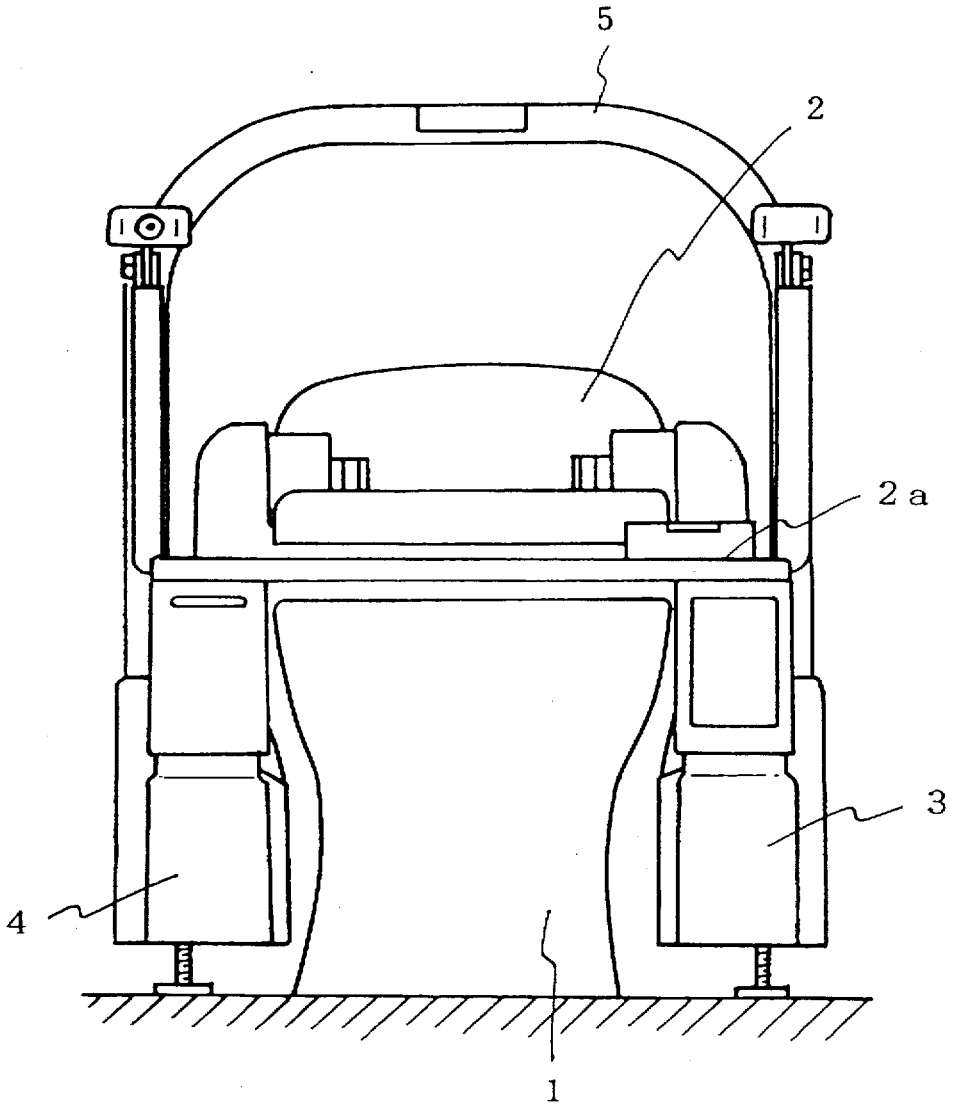
FIG. 16 is a front view of a combination of the device and a stool.
Figure 17:
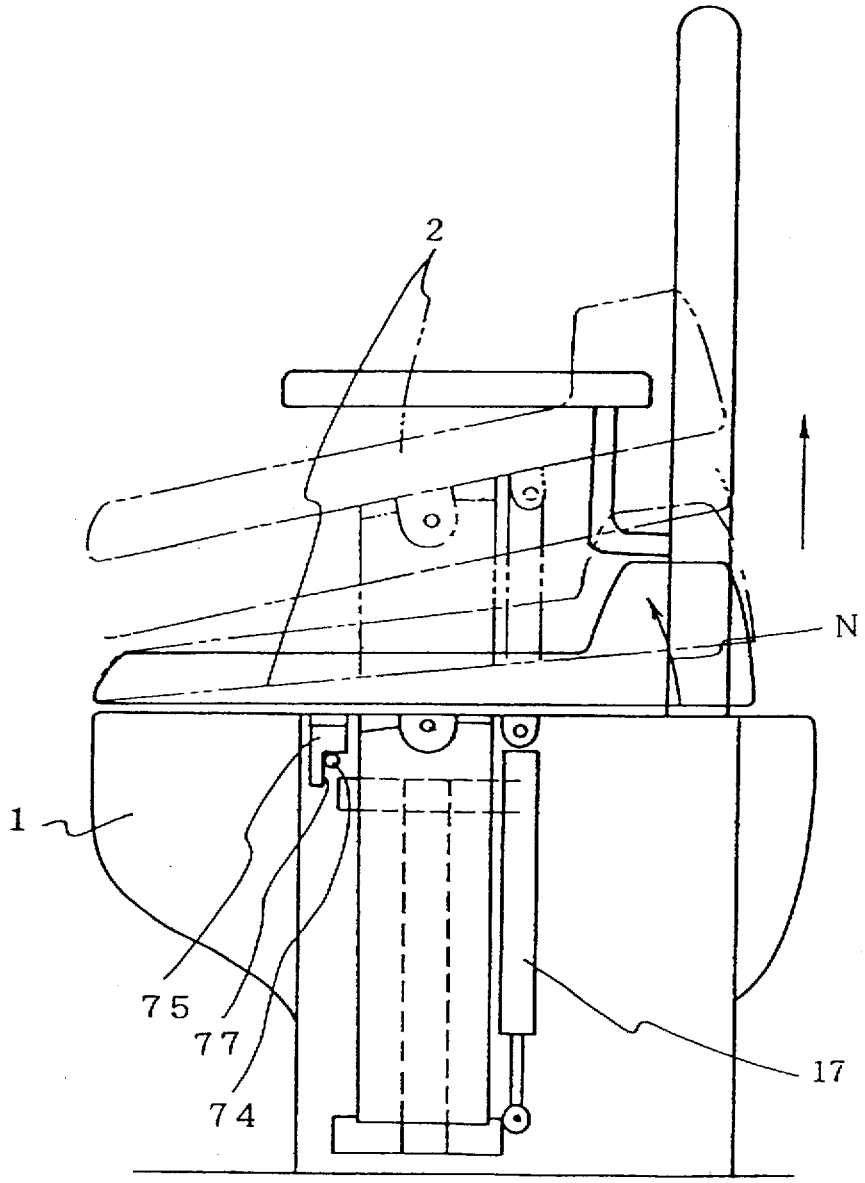
FIG. 17 is a side view of the device and a stool.

Further, in the embodiments of FIGS. 14, 16, the cam mechanisms are situated at a front portion with respect to the rotational axis of the tilting mechanism so that the interference between the cam mechanisms and the gas spring 17 can be avoided. However, the cam mechanism can be situated at another positions. The same function and the effect can also be obtained in this case.

The above-mentioned device B has a cam mechanism for tilting the seat-supporting member in accordance with the vertical motion. Therefore, in the device B, the tilting motion and the return motion are more smooth than the device A in which a stopper abuts against the seat-supporting member at the bottom of stroke. Further, since the position of cam surface can be adjusted, it is easy to adjust the position of start of tilting motion and the tilting locus, by changing and/or adding simple construction. Especially, in a device having a set of separated left and right unit, there is an additional merit that the timing of tilting motion can be easily accorded mutually. Further, by adding merely simple parts, a mode selecting mechanism for selecting either of posture keeping mode or a tilting mode can be obtained.

As mentioned above, in the present embodiment, the tilting motion is obtained by a cam mechanism and only the seat supporting members are tilted. Therefore, there is no necessity to change the moving direction of the sliding plate. Therefore, not only a wrapping power transmitting member, such as a chain, belt, cable, and the like, but also various kinds of means for directly changing a rotary motion to a vertical motion can be employed. For example, a pinion-rack mechanism, nut-screw mechanism and the like can be employed in the present embodiment. Further, pneumatic cylinder or a linear motor also can be employed as a power source.

Next, referring to FIG. 11 and FIG. 12 a cover assembly will be explained hereinafter. In the device B of FIG. 11 and FIG. 12, the mechanism portions K are housed and protected in static covers of the left or right units. As shown in FIG. 12, the static cover 72 has a front portion 81 for protecting the seat-lifting portion 7 and a rear portion 82 for protecting the cable-driving portion 10. The front portion 81 is relatively narrower in width and relatively higher than the rear portion 82. Further, an opening 84 is formed at the top of the front portion 81 so that the seat-supporting member 15 and the like can go up through the opening 84. The periphery of the opening 84 is formed as a tubular shape with square cross section. Further, the front portion 81 has a step 83 at a middle height position.

The rear portion 82 is wider and lower than the front portion 81. The upper opening 84 of the front portion 81 is covered with a movable cover 73 which moves together with the seat-supporting member 15. The movable cover 73 has a box-like shape with an open bottom. Further, a rear end of the movable cover 73 is partially cut away from the bottom to the middle portion in the vertical direction (see FIG. 21), in order to prevent interference with the rear portion 82.

Figure 21:
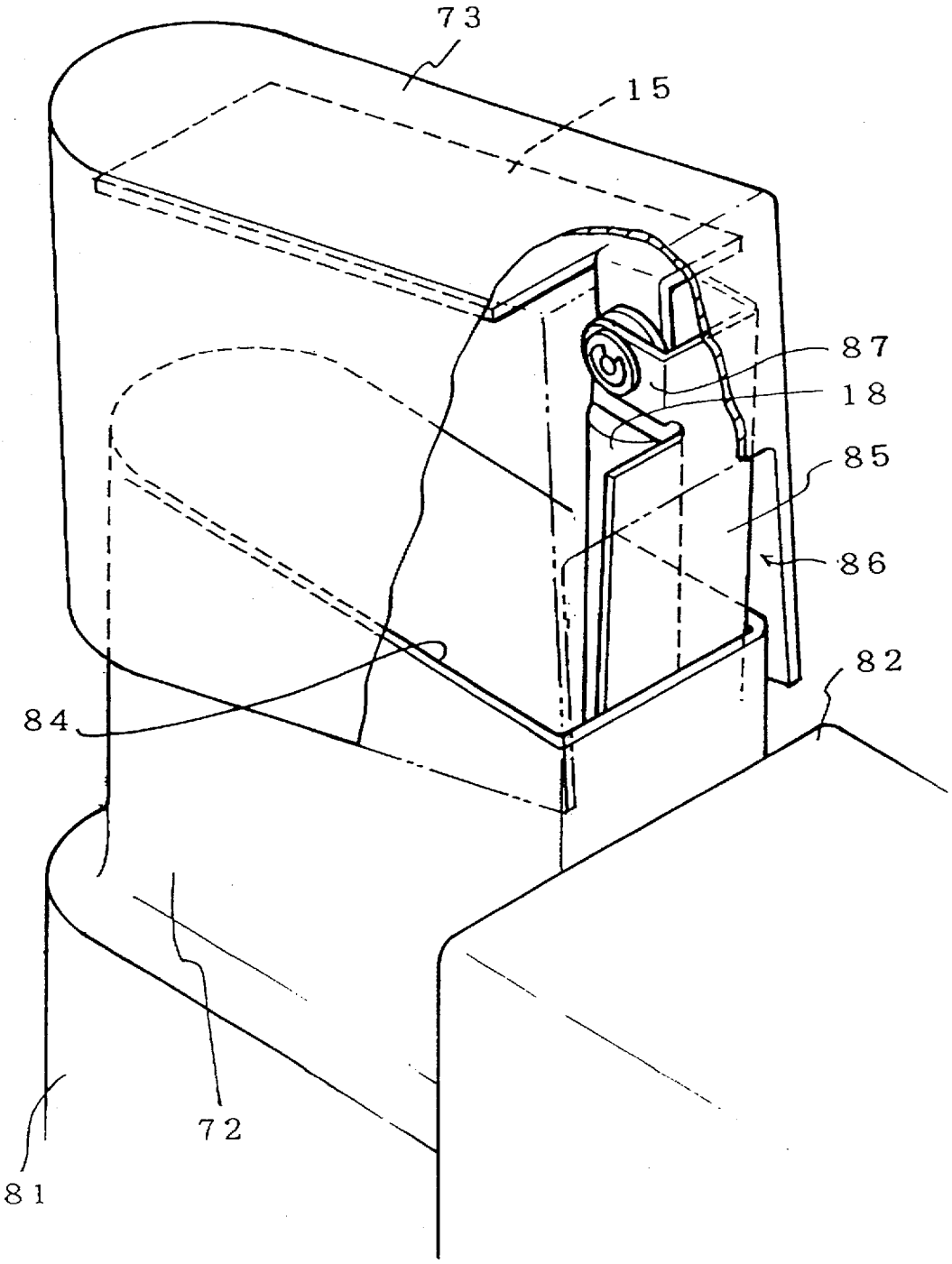
FIG. 21 is a partially-cut-off perspective view showing back side of the covering structure.

If the movable cover 73 is formed in a sufficient large size capable of covering whole static cover 72, the cut away portion 86 in FIG. 21 is not required. However, such large movable cover is not preferable. Therefore, in the present embodiment, a square tubular upper portion is employed and a movable cover 73 with relatively small size are employed.

Next, with reference to FIGS. 19 to 21, a preferable sliding cover 85 and a means for attaching the sliding cover 85 will be explained. As mentioned above, the movable cover 73 is a member to close the upper opening 84 of the static cover 72. The movable cover 73 has a height larger than the vertical stroke of the seat-supporting member 15 so that the movable cover 73 can cover the upper opening 84 even the sliding plate 13 goes upward. Therefore, the rear portion of the movable cover 73 has a cut away portion or rear opening 86 so as not to abut against the rear portion 82.

Though the cut away portion 86 can be covered with a static cover 72 when the movable cover 73 descends to the bottom, the rear opening 86 becomes open when the movable cover 73 ascends. In the present embodiment, a sliding panel or sliding cover 85 is therefore applied. The sliding cover 85 is arranged at the inside of the square tubular portion so as to cover the rear opening 86. Therefore, the sliding cover 85 can be sufficiently extended downward. Therefore, the movable cover 73 and the sliding cover 85 can move up and down without remaining open portion.

Beside, if the seat-supporting member merely moves up and down, it is sufficient to fix the upper portion of the sliding cover 85 to the rear end of the seat-supporting member 15. However, if the seat-supporting member not only can slide up and down, but also can tilt between a posture tilted to front side and a horizontal posture, the sliding cover 85 may interfere with the static cover 72 when the seat-supporting member 15 tilt to the front side, for example. This problem can be solved by joinning an upper end of the sliding cover 85 to the rear end of the seat-supporting member 15 by means of a pin joint or the like. In this case, the sliding cover 85 can rotate around the axis of the pin joint or the like. When this covering assembly is employed, the sliding cover does not tilt even the seat-supporting member tilts to the front side. Further, the lower portion of the sliding cover 85 is preferably guided by a guide member attached to an inner surface of the static cover 72 or another guide fixed on the base plate 6, so that the sliding plate 85 is prevented from swinging. The sliding cover 85 can be attached to the sliding plate 13. However, it is not desirable, since the guide frame 14 becomes obstacle and the construction becomes troublesome.

Figure 19:
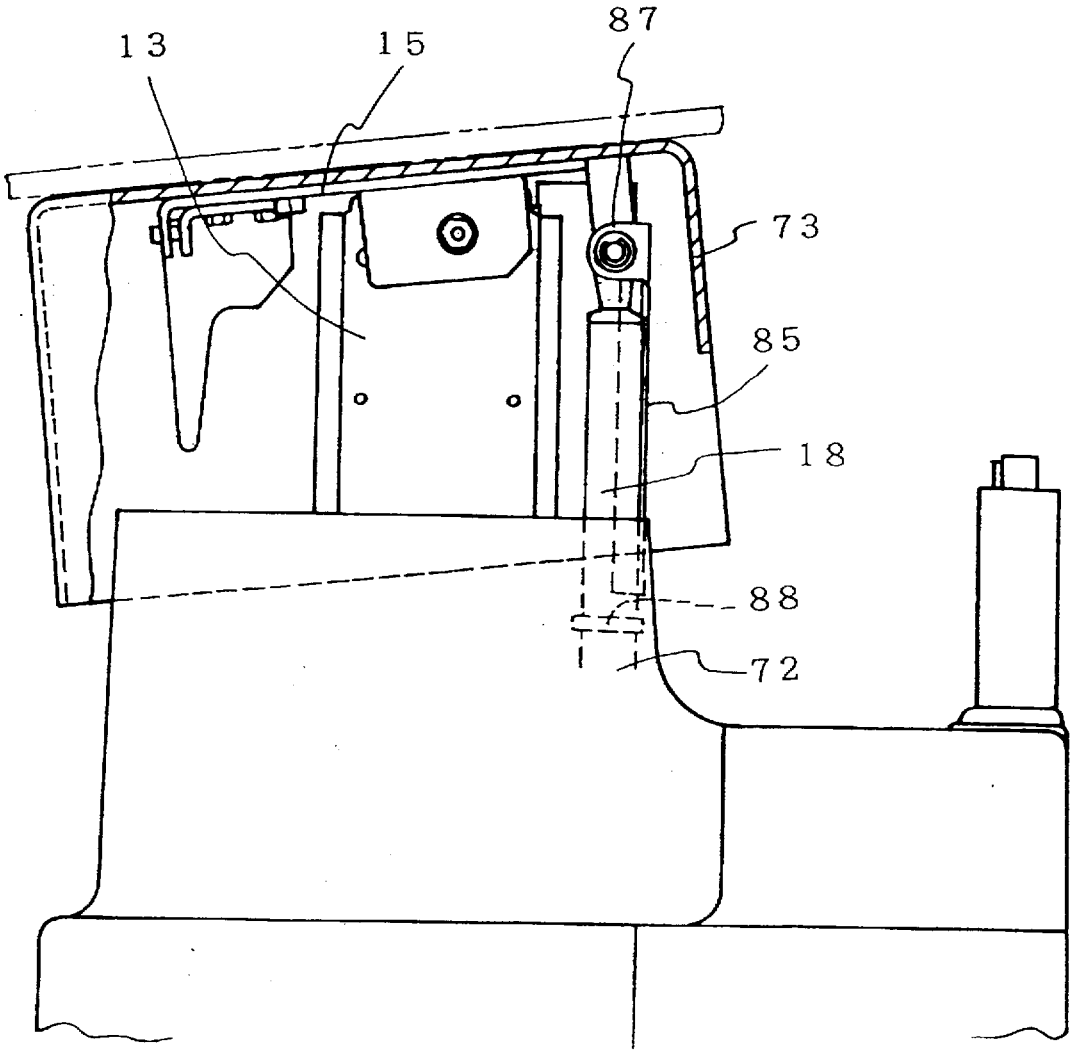
FIG. 19 is a partially-cut-off side view showing an embodiment of a covering structure in the device of the present invention.
Figure 20:
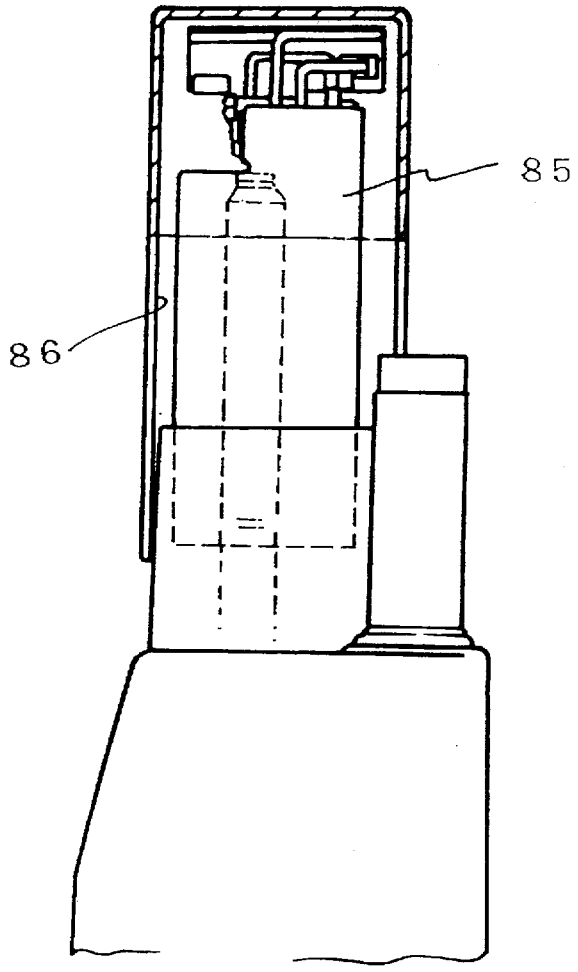
FIG. 20 is a right handed side view of the covering structure.

FIGS. 19 to 21 show another preferable embodiment. In the seat-lifting device B, a gas spring 17 is employed. The gas spring 17 has a cylinder 18 extending vertically, and the cylinder 18 moves vertically in accordance with the vertical motion of the seat-supporting member 15 with keeping almost vertical posture. In the present embodiment, the sliding cover 85 is closely attached to the cylinder 18 of the gas spring 17.

Then, a bent piece 87 is formed at the upper end of the sliding cover 85, and the bent piece 87 is attached to a pin for attaching the upper end of the gas spring 17. Further, the lower end of the sliding cover 85 is attached to a middle portion of the cylinder 18 by means of a band clip 88 or the like. Therefore, the sliding cover 85 can be securely supported by the cylinder 18. The upper side of the sliding cover 85 can be preferably attached to the cylinder 18 with another band clip or the like. The sliding cover 85 is preferably bent to form an L-shaped or C-shaped plan view so that hardness is improved.

In the above-mentioned covering assembly, the movable cover 73 has a top plate and side walls with remaining the rear side open. Therefore, when the seat-supporting member 15 is lifted up, the rear side opens. However, since a sliding cover 85 is provided at the inside of the static cover 72 so as to move synchronously with the vertical motion of the seat-supporting member, the rear side opening 86 can be closed by the sliding cover 85. Further, even the seat-supporting member 15 tilts to the front side, the sliding cover 85 does not interfere with the static cover 72, since the sliding cover 85 does not tilt.

When the sliding cover 85 is attached to the cylinder 18 of the gas spring 17, the sliding cover 85 is attached and the cylinder 18 moves up and down synchronously with the sliding cover 85 and the seat-supporting member 15. Further, since the gas spring 17 is supported at the upper end and the lower end, the posture of the gas spring 17 is stable. Therefore, the sliding cover 85 can close the rear opening 86 regardless of position and angle of the movable cover 73, and the sliding cover 85 does not disturb those motions of the movable cover 73.

In the device B shown in FIG. 11 and FIG. 12, a control circuit board (90 in FIG. 22) for a motor M and a power source circuit board (91 in FIG. 22) are installed in the static cover 72 of each unit 3, 4 together with the inner mechanism K.

Figure 24:
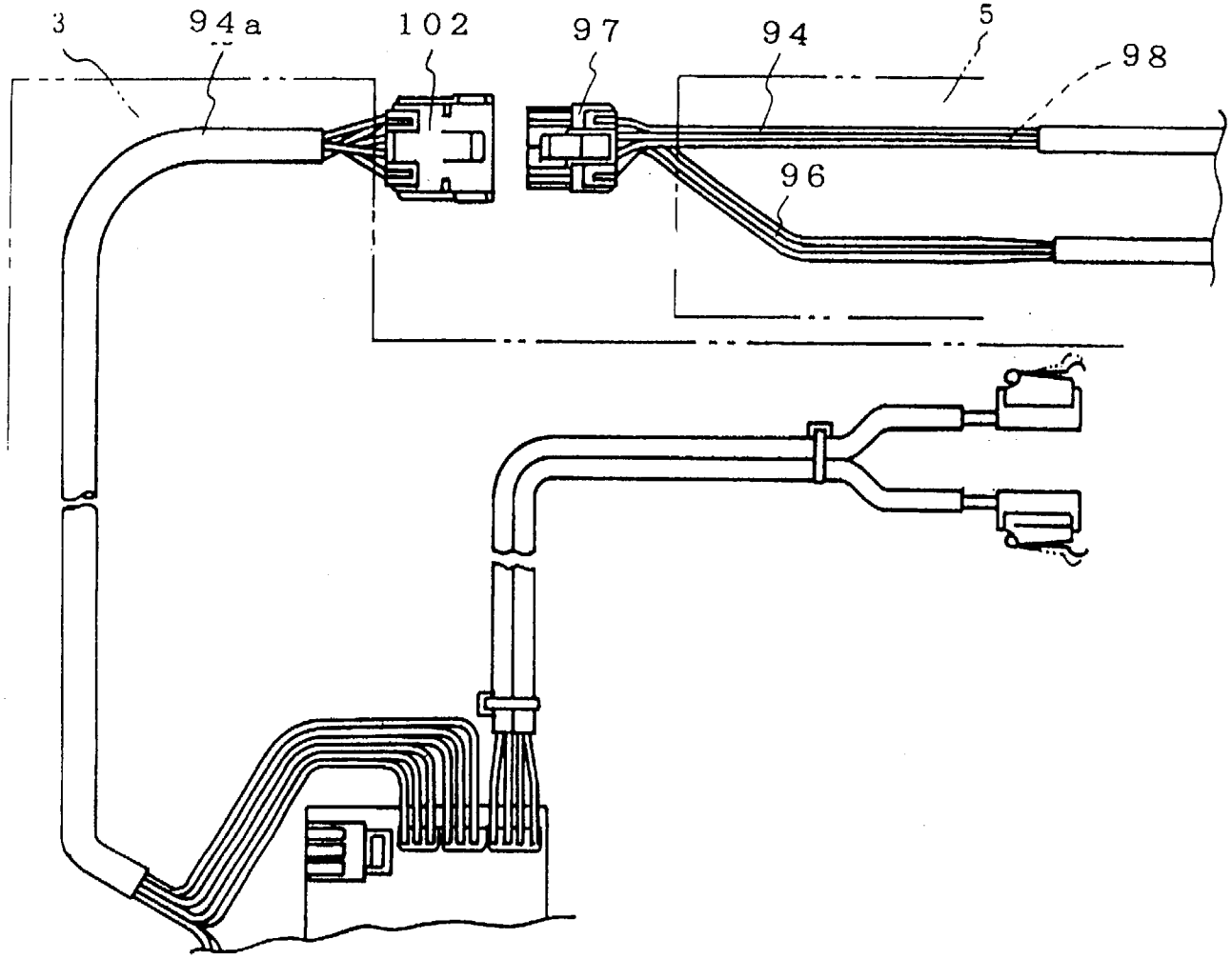
FIG. 24 is a partially enlarged view of FIG. 23.

Further, in the present embodiment, square pipes 92, 93 are foldably attached to the vertical portions of the connecting frame 5. An operation switch SW is attached at the free end of the left handed square pipe 93. An arm member or arm cover 5*a* is attached on each square pipe 92, 93. Electric cords 94 for power source and control signal are inserted through the connecting frame 5 made of a pipe. Further, cords 96 for the operation switch SW are inserted through the vertical portions of the connecting frame 5 from the lower end to a middle portion, and the cords 96 are further extend through the square pipes 92, 93. The cords 94 for power source and control signal and the cords 96 for the operation switch SW are connected to the same connector 97 at the lower end of the connecting frame 5. Terminals in the left and right connectors 97 of the cords 96 for the switch SW are connected mutually through another cords (98 in FIG. 24), so that the left and right cords 96 for the switch SW are connected in parallel. Therefore, a connector 100 of the switch SW can be connected to either connector 99 of the left or right arm 5*a* on user's demand. The operation switch SW is a switch for changing motion of the seat-lifting device, i.e. ascending, descending or stop of the seat.

As shown in FIG. 12 and FIG. 13, a pair of supporting pipes 101 for supporting the lower ends of the connecting frame 5 are fixed to the base plates 6 in the unit 3, 4 so as to extend vertically. In the supporting pipe 101, another connector 102 and cords 103 to be jointed with the above-mentioned connector 97 for the cords 94 are installed. In FIG. 13, at a position near the upper end of the guide rail 11, a limit switch LS1 to detect the upper end of the stroke of the carrier plate 12 is attached. Another limit switch LS2 is attached to a position near the lower end of the guide rail 11.

Figure 22:
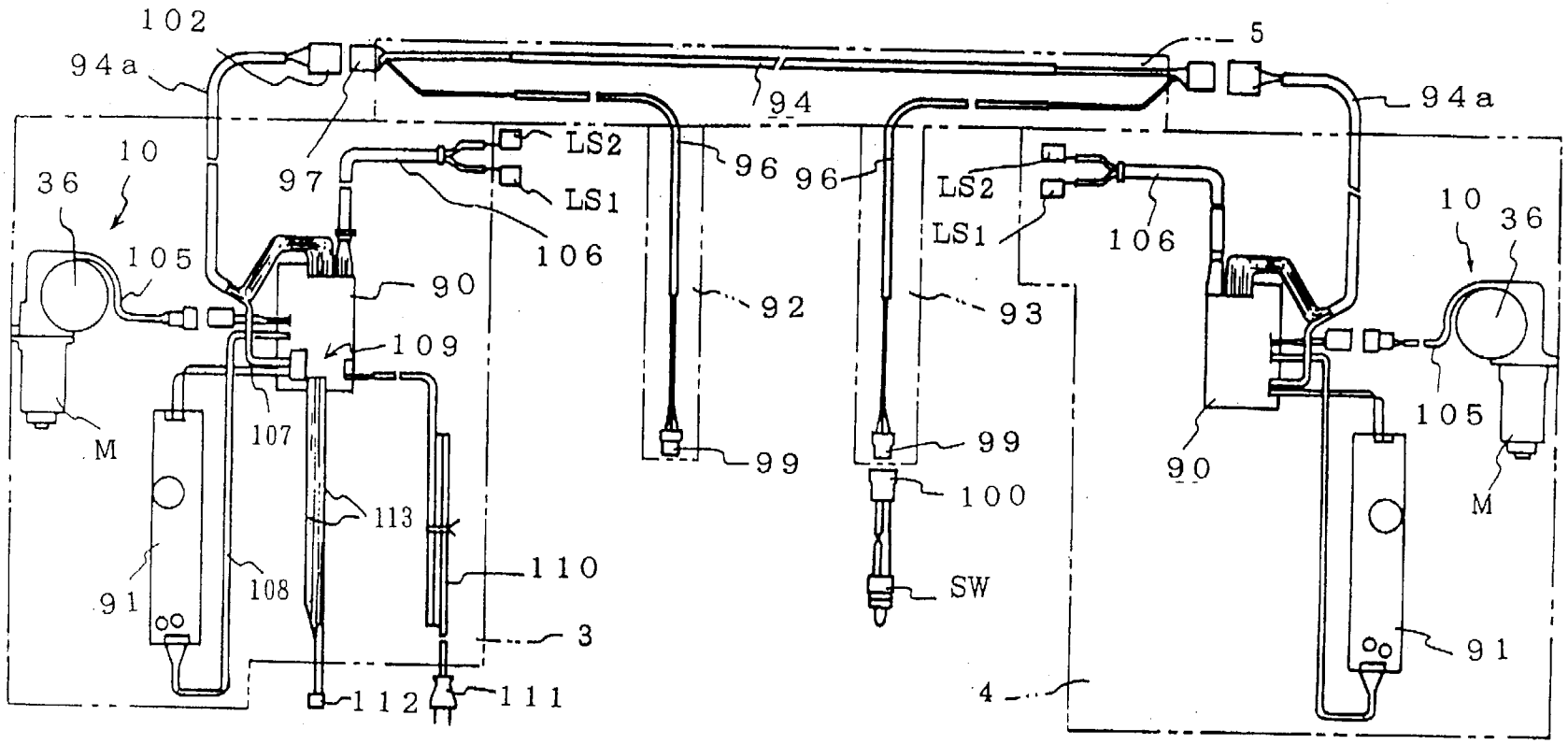
FIG. 22 is a wiring diagram showing an embodiment of an electric control system in the device of the present invention.

The above-mentioned electric elements are wired as shown in FIG. 22. The power source cords 105 for the motor M, the cords 106 for the limit switches LS1, LS2 and the A.C. power source cords 94*a* are connected to the control circuit board 90. Cords 107, 108 from the power source board 91 are also connected to the control circuit board 90. The power source board 91 has a circuit for converting domestic alternate current to direct current of 24 volts, for example.

In the device B of the present embodiment, each unit 3,4 has own power source boad 91, and each unit 3, 4 is supplied with A.C. The convert from A.C. to D.C. is performed in each unit 3, 4. Output of the power source board 91 is used in each control board 90 and for power source for the motor M. The control board 90 can be attached on the cable-driving portion 10 (see FIG. 13), and the power source board 91 can be attached on a back side of the base plate 6.

In the above-mentioned embodiment, an input circuit 109 from domestic electric power source is mounted on the control circuit board 90 in the right units 3, for example. The input circuit 109 of the right unit 3 is supplied with the alternate current through a cord 110 and a plug 111. The input circuit 109 of the left unit 4 is supplied with A.C. through the power source cord 94*a*. Further, a main switch 112 for power source for the whole device is connected through a cord 113. The reference mark E in FIG. 12 denotes an earth wire.

Figure 23:
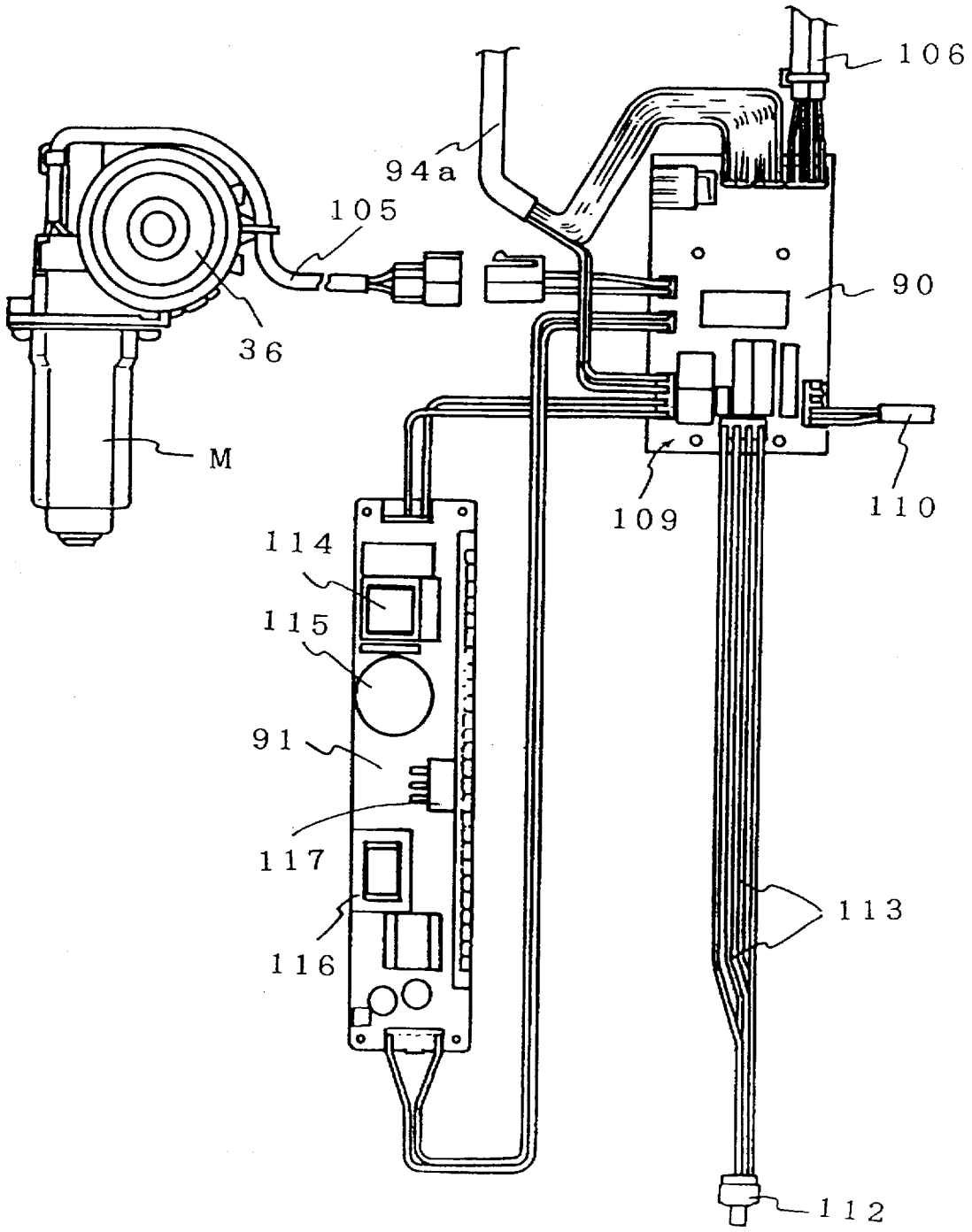
FIG. 23 is a partially enlarged view of FIG. 22.

As shown in FIG. 23, the power source board 91 has a known "switching regulator" having a transformer 114, a capacitor 115, a choke coil 116, a transistor 117 and the like. Therefore, the power source board 91 can be made small. Further, since each power source board 91 is provided for each unit 3, 4, the power source board 91 can be made further smaller. Therefore, the size of each unit 3,4 can be made small. Further, power converting efficiency is good, and generated heat is little.

The motor M rotates in both directions for ascent and descent of seat. Therefore, at least three cords, i.e. a common line, an ascent line and a descent line, are required for controlling the motor M. Therefore, as the cords 94 extend between left and right unit 3, 4, a cabtire cable with five or more lines, i.e. three lines for control and two lines for power source is suitably used. The control cords 96 for the operation switch SW are the same as the above-mentioned cords 94, excepting the cords for power source. That is to say, a cabtire cable with three or more lines, i.e. for common, ascent and descent is suitably employed.

In the above-mentioned device B, a connecting frame 5 made of inverse-U-shaped pipe is used. Therefore, the connecting frame 5 can be easily attached by inserting or applying the lower ends thereof to the supporting pipes 101 after setting of the left and right lifting units 3, 4. However, the form of the connecting frame in the present invention is not limited to the inverse-U-shape, but any form of member, e.g. H-shaped, I-shaped, which can connect securely the left and right units mutually, can be employed in the present invention.

As mentioned above, the seat-lifting device of the present invention can be easily assembled even in a narrow space, since the device is separated to a left unit, a right unit and a connecting member. Further, the device can be easily applied to an existing stool. Further, electric cords are protected and appearance is good, since the cords are housed in a pipe-shaped connecting frame.

Though various preferred embodiments are described above with reference to the attached drawings, the present invention is not limited to those embodiments, and various changes and modifications can be made without departing from the scope and spirit of the invention as claimed herein.

What we claim is:

1. A seat-lifting device for raising and lowering a seat relative to a stool, comprising:

a pair of left and right static guides to be set on left and right sides of the stool respectively;

left and right moving members provided on the left and right static guides respectively, for up-and-down sliding motion relative thereto, each moving member having a seat-supporting portion; and left and right actuating mechanisms, for actuating the moving members in up or down motion, respectively provided at said left and right static guides, wherein each actuating mechanism has a pair of direction changing members attached to upper and lower ends of the static guide, a pull cable arranged between the direction changing members and having a portion connected to a lower portion of the moving member, and a motor-powered cable-driving means for alternately pulling ends of the pull cable.

2. The seat-lifting device of claim 1, further comprising:

a connecting frame bridging the left and right static guides mutually.

3. The seat-lifting device of claim 2, wherein:

the connecting frame has a portion to be fixed on the stool.

4. The seat-lifting device of claim 2, wherein:

the connecting frame is made of a pipe;

the left static guide and the left actuating mechanisms are combined as a left unit;

the right static guide and the right actuating mechanism are combined as a right unit; and cords for electrically connecting the left and right units are inserted through the connecting frame.

5. The seat-lifting device of claim 4, wherein:

the connecting pipe has an inverse-U-shaped form having a pair of vertical portions and a lateral portion connecting upper ends of the vertical portions mutually.

6. The seat-lifting device of claim 4, wherein:

the cords in the connecting frame are separated by means of connectors at positions where the connecting frame and the static guides are joined.

7. The seat-lifting device of claim 4, further comprising:

the cords including left and right control cords; and an operation switch which can be selectively connected with either of the left and right control cords.

8. The seat-lifting device of claim 7, further comprising:

a pair of arms attached to the vertical portions of the connecting frame;

wherein the left and right control codes are inserted through the respective arms; and each arm has a portion for attaching to the operation switch selectively.

9. The seat-lifting device of claim 4, wherein:

each unit has a control circuit and a power circuit;

one of the units has an input circuit to be supplied with power from an outer power source and a main switch interposed between the input circuit and the power circuit; and a power circuit of another unit is supplied with power from the input circuit through the main switch and the cords in the connecting frame.

10. The seat-lifting device of claim 9, wherein:

each power circuit is a switching regulator circuit.

11. The seat-lifting device of claim 1, further comprising:

means for urging the moving member upward, interposed between the moving member and the static guide.

12. The seat-lifting device of claim 1, wherein:

the seat-supporting portions of the left and right moving members are a pair of seat-supporting members which are mounted on upper portions of the left and right moving members so as to rotate around a common rotational axis in a range between a horizontal posture and a posture tilted in front side; and each seat-supporting member is elastically urged to tilt in the front side by respective urging means.

13. The seat-lifting device of claim 12, wherein:

each urging means comprises a compression spring interposed between a rear portion of the seat-supporting member and the static guide so that the seat supporting member is urged upward.

14. The seat-lifting device of claim 1, further comprising:

a cam mechanism interposed between the seat-supporting member and the static guide for providing a tilting motion of the seat-supporting member between a posture tilted in a front side and a horizontal posture as the sliding members move up and down, respectively.

15. The seat-lifting device of claim 14, wherein:

the cam mechanism has a cam member having a cam surface extending in an up-and-down direction, and a cam roller capable of abutting against the cam member so as to support the seat-supporting member from a front side rotation.

16. The seat-lifting device of claim 14, wherein:

at least one of the cam surface and the cam roller is attached so that the seat position is adjustable in a front-and-back direction.

17. The seat-lifting device of claim 14, further comprising:

a means for urging the seat-supporting member to rotate to a front side.

18. The seat-lifting device of claim 17, wherein:

the urging means is a spring for pressing up a rear side of the seat-supporting member.

19. A seat-lifting device for raising and lowering a seat relative to a stool, comprising:

a pair of left and right static guides to be set on left and right sides of the stool respectively;

left and right moving members provided on the left and right static guides respectively, for up-and-down sliding motion relative thereto, each moving member having a seat-supporting portion; and an actuating mechanism for actuating the moving members in up or down motion, the actuating mechanism being situated at a position near a static guide;

wherein the seat-supporting portions of the left and right moving members are a pair of seat-supporting members which are mounted on upper portions of the left and right moving members so as to rotate around a common rotational axis in a range between a horizontal posture and a posture tilted in a front side, each seat-supporting member is elastically urged to tilt in the front side by respective urging means; and the static guide is covered with a static cover, the static cover has a tubular portion enclosing the static guide and an opening at an upper end thereof, a movable cover is mounted on the seat-supporting member, the movable cover has a box-like shape with a top plate and side walls with a rear portion open, and a sliding inner cover is situated at a rear side of the movable cover and an inside of the static cover so that the sliding cover can move synchronously with the up-and-down motion of the moving member so as to close the open rear portion of the movable cover.

20. The seat-lifting device of claim 19, wherein:

a gas spring is interposed between the seat-supporting member and the static guide; and the sliding cover is attached to the gas spring.

* * * * *